US011194276B2

(12) United States Patent
Yamazaki et al.

(10) Patent No.: US 11,194,276 B2
(45) Date of Patent: Dec. 7, 2021

(54) HEATING DEVICE, FIXING DEVICE, AND IMAGE FORMING APPARATUS

(71) Applicant: FUJIFILM Business Innovation Corp., Tokyo (JP)

(72) Inventors: Hiroki Yamazaki, Ebina (JP); Mizuki Sugino, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/931,989

(22) Filed: Jul. 17, 2020

(65) Prior Publication Data

US 2021/0286303 A1 Sep. 16, 2021

(30) Foreign Application Priority Data

Mar. 16, 2020 (JP) ..... JP2020-045870
Mar. 16, 2020 (JP) ..... JP2020-045871

(51) Int. Cl.
*G03G 15/20* (2006.01)

(52) U.S. Cl.
CPC ..... *G03G 15/2064* (2013.01); *G03G 15/2039* (2013.01); *G03G 15/2053* (2013.01); *G03G 2215/2038* (2013.01)

(58) Field of Classification Search
None
See application file for complete search history.

(56) References Cited

U.S. PATENT DOCUMENTS

2010/0158553 A1* 6/2010 Ueno ..... G03G 15/2064 399/67
2012/0057910 A1* 3/2012 Matsumoto ..... G03G 15/206 399/329

FOREIGN PATENT DOCUMENTS

JP 2004-53674 A 2/2004

* cited by examiner

*Primary Examiner* — Victor Verbitsky
(74) *Attorney, Agent, or Firm* — Sughrue Mion, PLLC

(57) ABSTRACT

A heating device includes: a rotating body; a heating body as defined herein; and a contact mechanism, in a non-existence state where a material to be heated does not exist between the rotating body and the heating body after the material to be heated passes between the rotating body and the heating body, configured to cause the rotating body to be in contact with the heating body at a central portion of the rotating body in a rotation axis direction of the rotating body, so that an area of the rotating body in contact with the heating body is smaller at each of both end portions of the rotating body than at the central portion of the rotating body in the rotation axis direction, or configured to switch the rotating body between a first contact state and a second contact state as defined herein.

18 Claims, 18 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Applications No. 2020-045870 and No. 2020-045871 which were filed on Mar. 16, 2020.

BACKGROUND

1. Technical Field

The present invention relates to a heating device, a fixing device, and an image forming apparatus.

2. Related Art

JP-A-2004-53674 discloses a fixing device. The fixing device includes a heating rotating body heated by a heating member, and a pressure rotating body that forms a fixing nip portion with the heating rotating body by being slidably in contact with the heating rotating body. The fixing device heats and pressurizes a recording sheet on which an unfixed toner image is transferred while nipping and transporting the recording sheet at the fixing nip portion, so that the unfixed toner image is fixed on a surface of the recording sheet. In the fixing device, a heat transfer member detachably attached to any one of the rotating bodies is provided.

SUMMARY

When a to-be-heated material such as a sheet passes through between a rotating body such as a pressure roller and a heating body such as a heating belt at a central portion in a rotation axis direction, a temperature of a central portion of the rotating body in a rotation axis direction is lower than a temperature of both end portions in the rotation axis direction. Accordingly, temperature unevenness in a rotation axis direction may occur in the rotating body.

Aspects of non-limiting embodiments of the present disclosure related to a heating device is to reduce temperature unevenness in a rotation axis direction of a rotating body in a short time after a to-be-heated material passes through between a central portion of the rotating body in the rotation axis direction and a central portion of a heating body in a rotation axis direction, as compared with a configuration in which a range of contact between a rotating body and a heating body continues to be the same at a central portion in a rotation axis direction and both end portions in the rotation axis direction, in a state where the to-be-heated material does not exist between the rotating body and the heating body after the to-be-heated material passes therethrough.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device comprising a rotating body; a heating body configured to rotate together with the rotating body, and heat a material to be heated while sandwiching and transporting the material to be heated between the heating body and the rotating body; and a contact mechanism configured to cause the rotating body to be in contact with the heating body at a central portion of the rotating body in a rotation axis direction of the rotating body, the heating body being configured to heat the rotating body while rotating together with the rotating body, so that an area of the rotating body in contact with the heating body at each of both end portions of the rotating body in the rotation axis direction is smaller than an area of the rotating body in contact with the heating body at the central portion of the rotating body in the rotation axis direction, in a non-existence state where the material to be heated does not exist between the rotating body and the heating body after the material to be heated passes between the rotating body and the heating body.

BRIEF DESCRIPTION OF DRAWINGS

Exemplary embodiments of the present invention will be described in detail based on the following figures, wherein.

DETAILED DESCRIPTION

Hereinafter, an example of an exemplary embodiment according to the present invention will be described with reference to the drawings.

First Exemplary Embodiment (Image Forming Apparatus 10)

Figure 1:
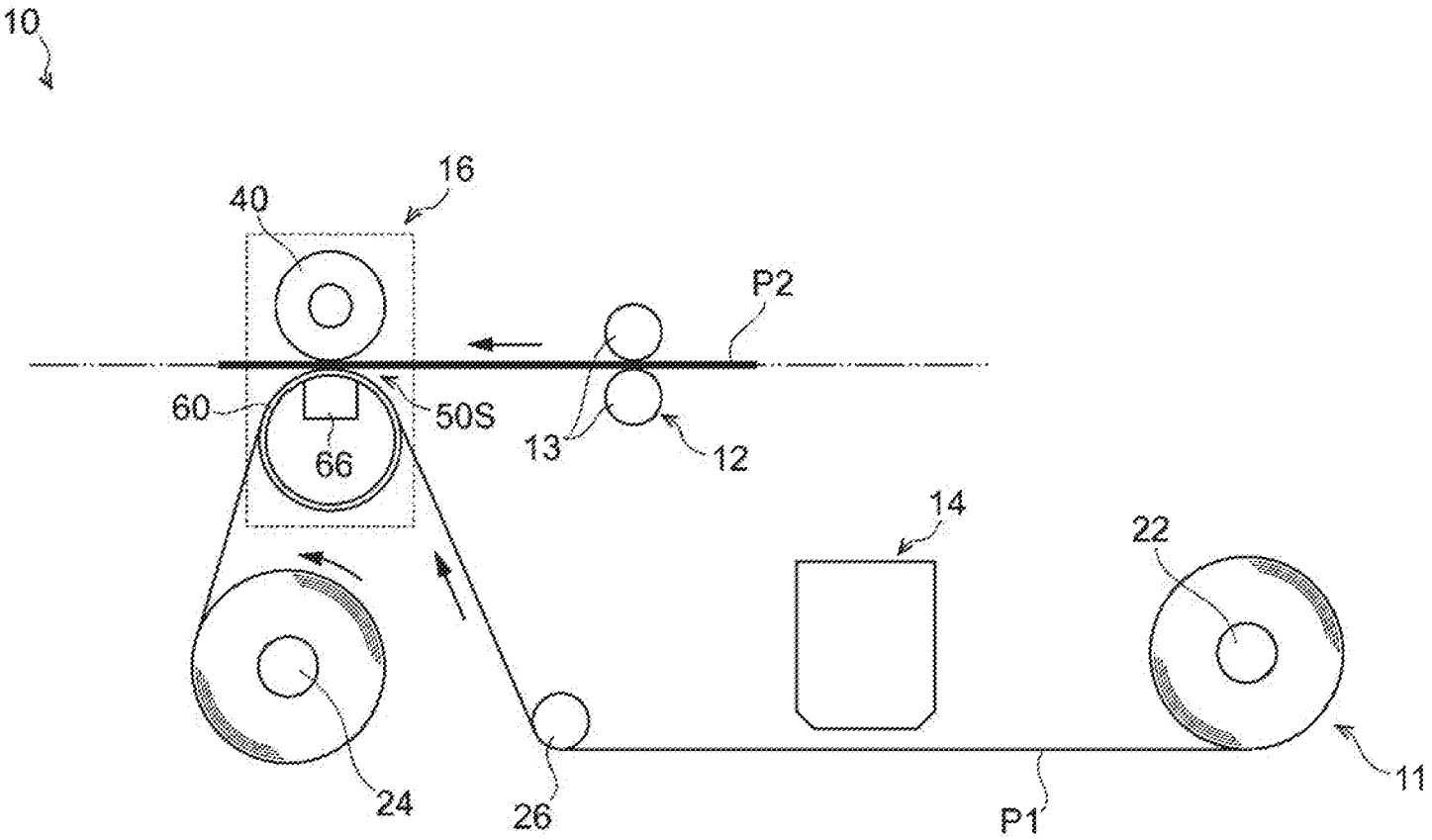
FIG. 1 is a schematic diagram showing a configuration of an image forming apparatus according to first and fourth exemplary embodiments.

First, a configuration of an image forming apparatus 10 according to the present exemplary embodiment will be described. FIG. 1 is a schematic diagram showing the configuration of the image forming apparatus 10 according to the present exemplary embodiment.

As shown in FIG. 1, the image forming apparatus 10 includes a first transport unit 11, a second transport unit 12, a forming unit 14, and a fixing device 16. The first transport unit 11 has a function of transporting a recording medium P1. Specifically, as shown in FIG. 1, the first transport unit 11 includes an unwinding roller 22, a winding roller 24, and a wrap roller 26.

The recording medium P1 is wound in advance around the unwinding roller 22. The unwinding roller 22 unwinds the wound recording medium P1 by rotating. The wrap roller 26 is wrapped around the recording medium P1 between the unwinding roller 22 and the winding roller 24. Accordingly, a transport path of the recording medium P1 from the unwinding roller 22 to the winding roller 24 is determined. The winding roller 24 is a roller that winds up the recording medium P1. The winding roller 24 is driven to rotate by a driving unit (not shown). Accordingly, the winding roller 24 winds up the recording medium P1 and the unwinding roller 22 unwinds the recording medium P1. Accordingly, the recording medium P1 is transported from the unwinding roller 22 to the winding roller 24. As an example, a hot stamp foil is used as the recording medium P1.

The forming unit 14 has a function of forming an image on the recording medium P1. Specifically, the forming unit 14 is a discharge unit that discharges a droplet. More specifically, the forming unit 14 is configured with a discharge head serving as the discharge unit that discharges an ink droplet serving as the droplet.

The second transport unit 12 has a function of transporting a recording medium P2 serving as an example of a to-be-heated material. The second transport unit 12 includes, for example, a transport roller pair 13. In the second transport unit 12, the recording medium P2 is transported to the fixing device 16 at a timing at which the image formed on the recording medium P1 is transported to the fixing device 16 (specifically, a contact region 50S to be described later). A sheet is used as an example of the recording medium P2. Here, the recording medium P1 is a roller sheet and the recording medium P2 is a cut sheet. Further, the recording medium P1 does not significantly influence a temperature of the fixing device 16 (specifically, a temperature of a pressure roller 40), and an influence of the temperature of the fixing device 16 decreasing due to a to-be-heated material is mainly caused by the recording medium P2.

The fixing device 16 transfers and fixes the image formed on the recording medium P1 onto the recording medium P2. A specific configuration of the fixing device 16 will be described later.

The forming unit 14 may be an electrophotographic image forming unit that forms a toner image as an image. In the electrophotographic image forming unit, for example, a toner image is formed on the recording medium P2 through steps such as charging, exposure, developing, and transfer.

Further, the forming unit 14 may directly form an image on the recording medium P2. In this case, for example, the fixing device 16 fixes the image formed on the recording medium P2 onto the recording medium P2.

(Fixing Device 16) The fixing device 16 shown in FIG. 1 is an example of a heating device. As shown in FIG. 1, the fixing device 16 includes a pressure roller 40 and a heating belt 60. While the recording medium P1 and the recording medium P2 are sandwiched and transported between the pressure roller 40 and the heating belt 60, the recording medium P1 and the recording medium P2 are pressurized and heated, and the image of the recording medium P1 is fixed onto the recording medium P2.

Accordingly, the fixing device 16 functions as a heating device that heats the recording medium P2 that is an example of the to-be-heated material. More specifically, the fixing device 16 includes a contact mechanism 70 (see FIG.

7) and a control device 50 (see FIG. 7) in addition to the pressure roller 40 and the heating belt 60. Hereinafter, a specific configuration of each unit of the fixing device 16 will be described.

(Pressure Roller 40 and Heating Belt 60) The heating belt 60 shown in FIG. 1 is an example of a heating body. The pressure roller 40 shown in FIG. 1 is an example of a rotating body. The pressure roller 40 and the heating belt 60 are arranged to face each other. In the present exemplary embodiment, as an example, the heating belt 60 is disposed on a lower side of the pressure roller 40 as shown in FIG. 1.

The heating belt 60 is formed in an annular shape, specifically, an endless shape. At least one of an inner peripheral side and an outer peripheral side of the heating belt 60 is provided with a heating unit (not shown) that heats the heating belt 60. As the heating unit, for example, a heating unit that heats the heating belt 60 by a heat generator that generates heat by Joule heat due to internal resistance, a heating unit such as a lamp that heats the heating belt 60 by radiant heat, and the like are used.

Figure 2:
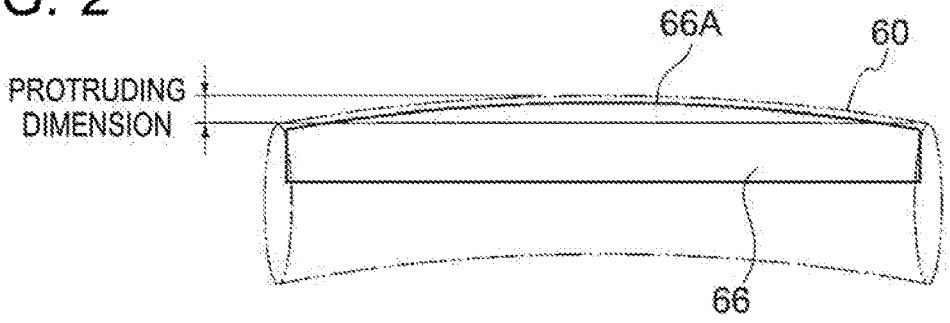
FIG. 2 is a schematic diagram showing a configuration of a heating belt according to the first and fourth exemplary embodiments.

As shown in FIG. 1, an inner periphery of the heating belt 60 on a pressure roller 40 side is provided with a pad 66 serving as a support portion. As shown in FIG. 2, the pad 66 has a length along a belt width direction of the heating belt 60. The pad 66 includes a support surface 66A that faces the pressure roller 40 side (that is, an upper side). The support surface 66A supports an inner peripheral surface of the heating belt 60. Further, the pad 66 is formed in a convex shape toward the pressure roller 40 side at a central portion in the belt width direction. Accordingly, the entire heating belt 60 is formed in the convex shape toward the pressure roller 40 side (that is, the upper side) at the central portion in the belt width direction.

The belt width direction is a direction intersecting a rotation direction in which the heating belt 60 is rotated (specifically, orthogonal direction). The belt width direction may also be referred to as a direction along a rotation axis direction of the pressure roller 40 (hereinafter, referred to as an axial direction).

Figure 3:
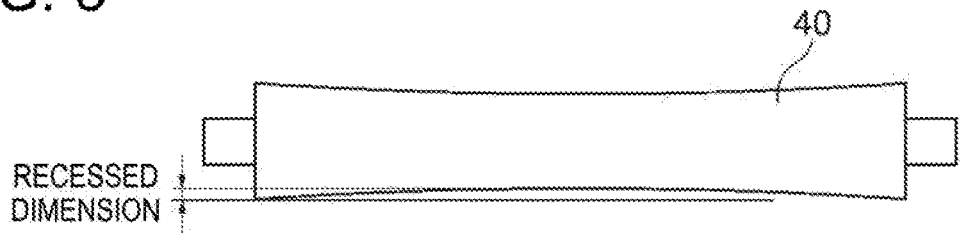
FIG. 3 is a schematic diagram showing a configuration of a pressure roller according to the first and fourth exemplary embodiments.

As shown in FIG. 3, the pressure roller 40 is a roller having, at both end portions in an axial direction, a diameter larger than that of a central portion. Specifically, an outer diameter of the pressure roller 40 is gradually increased from the central portion in the axial direction toward both end portions. More specifically, the outer diameter of the pressure roller 40 is continuously increased from the central portion in the axial direction toward both end portions. Accordingly, the diameter of both end portions of the pressure roller 40 in the axial direction is set to be larger than that of the central portion, so that a feed speed of the recording medium P2 by the pressure roller 40 is higher at both end portions in a width direction than at the central portion. Accordingly, tension acts from a center of the recording medium P2 in a width direction toward both end sides, and a wrinkle of the recording medium P2 is prevented.

A recessed dimension (see FIG. 3) of the central portion of the pressure roller 40 in the axial direction is smaller than a protruding dimension (see FIG. 2) of the central portion of the heating belt 60 in the axial direction on the pressure roller 40 side. The recessed dimension of the pressure roller 40 is a dimension along a radial direction from an outer peripheral surface of an end portion in the axial direction of the pressure roller 40 to an outer peripheral surface of the central portion in the axial direction (see FIG. 3). In other words, the recessed dimension of the pressure roller 40 is a radius difference between a maximum radius and a minimum radius of the pressure roller 40. The protruding dimension of the heating belt 60 is a dimension along a radial direction from an outer peripheral surface of an end portion in the belt width direction of the heating belt 60 to an outer peripheral surface of the central portion in the belt width direction. The protruding dimension of the heating belt 60 may be understood as a height difference between the end portion in the belt width direction and the central portion in the belt width direction of the support surface 66A of the pad 66.

Figure 4:
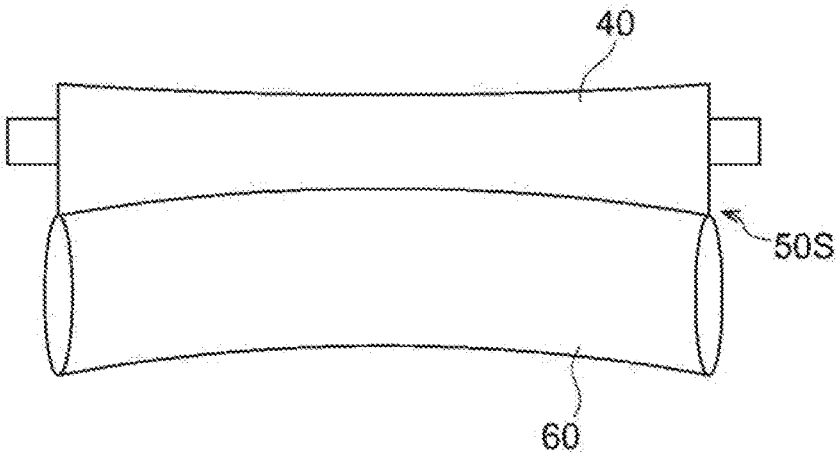
FIG. 4 is a schematic diagram showing a state where the pressure roller according to the first and fourth exemplary embodiments is positioned at a nip position.

As shown in FIGS. 1 and 4, the pressure roller 40 is pressed against the heating belt 60. Accordingly, the contact region 50S in which the heating belt 60 and the pressure roller 40 are in contact with each other (that is, a fixing nip) is formed. In other words, the contact region 50S is a region formed between the heating belt 60 and the pressure roller 40.

As will be described later, the pressure roller 40 is moved by the contact mechanism 70 to a contact position shown in FIGS. 1 and 4 (hereinafter, referred to as a nip position), a contact position shown in FIG. 5 (hereinafter, referred to as a central contact position), and a separated position shown in FIG. 6. The pressure roller 40 is pressed against the heating belt 60 at the nip position shown in FIG. 4.

Figure 7:
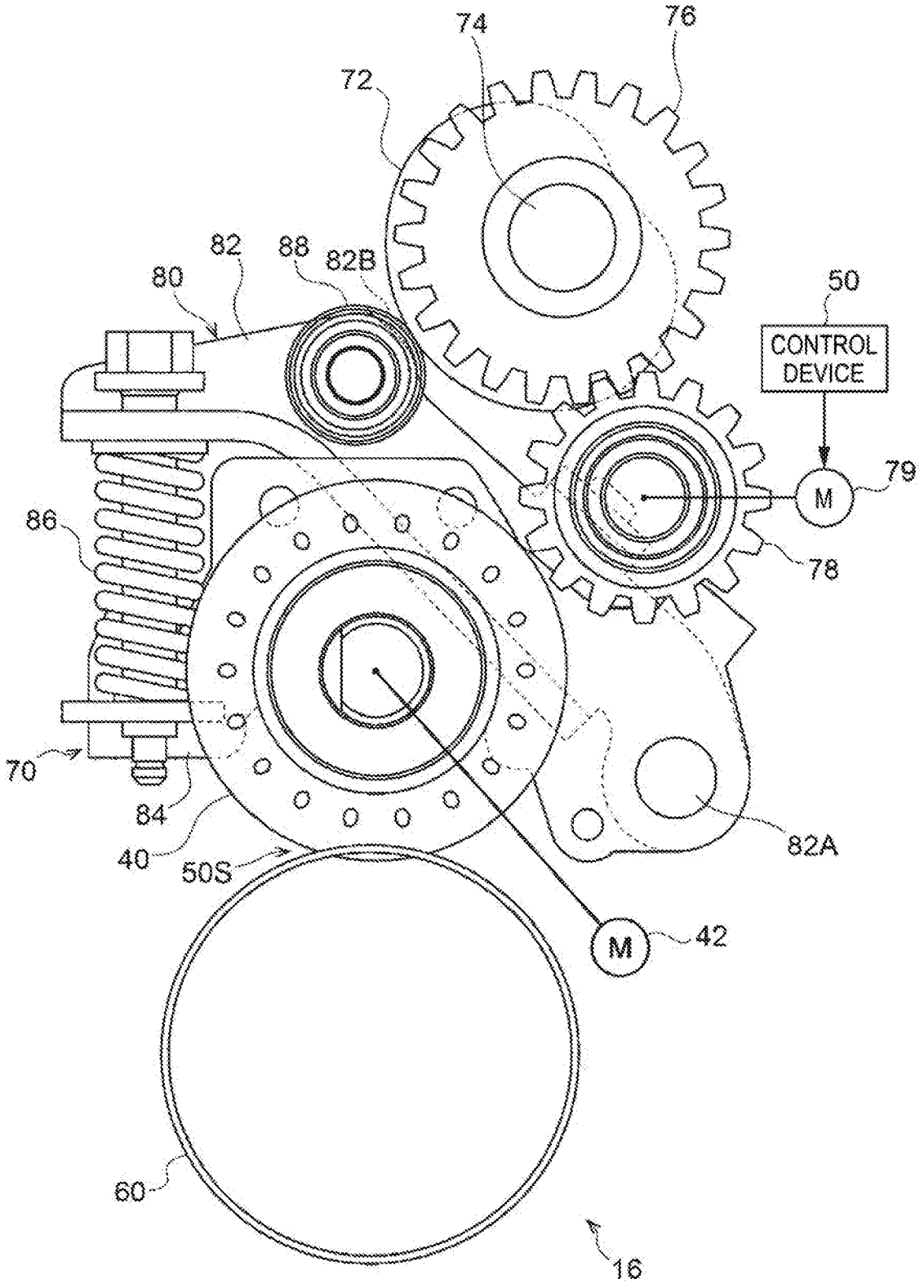
FIG. 7 is a front view showing a configuration of a contact mechanism according to the first exemplary embodiment.

Further, the pressure roller 40 is driven to rotate by a driving unit 42 (see FIG. 7). The heating belt 60 is rotated following the pressure roller 40. Accordingly, the heating belt 60 is rotated together with the pressure roller 40, and heats the recording medium P2 while the recording medium P2 is sandwiched and transported between the heating belt 60 and the pressure roller 40.

That is, in the fixing device 16, the recording medium P2 introduced into the contact region 50S is transported while being sandwiched and pressurized between the heating belt 60 and the pressure roller 40, and the image of the recording medium P1 is fixed onto the recording medium P2 by a pressing force and heat from the heating belt 60. Accordingly, in the present exemplary embodiment, the recording medium P2 is passed through the contact region 50S (that is, between the heating belt 60 and the pressure roller 40), so that the image of the recording medium P1 is fixed.

A center of the pressure roller 40 in the axial direction and a center of the heating belt 60 in the belt width direction substantially coincide with each other. Further, the recording medium P2 is transported by the heating belt 60 and the pressure roller 40 in a state where a center of the recording medium P2 in the width direction substantially coincides with the center of the pressure roller 40 in the axial direction and the center of the heating belt 60 in the belt width direction (that is, center register).

Figure 8:
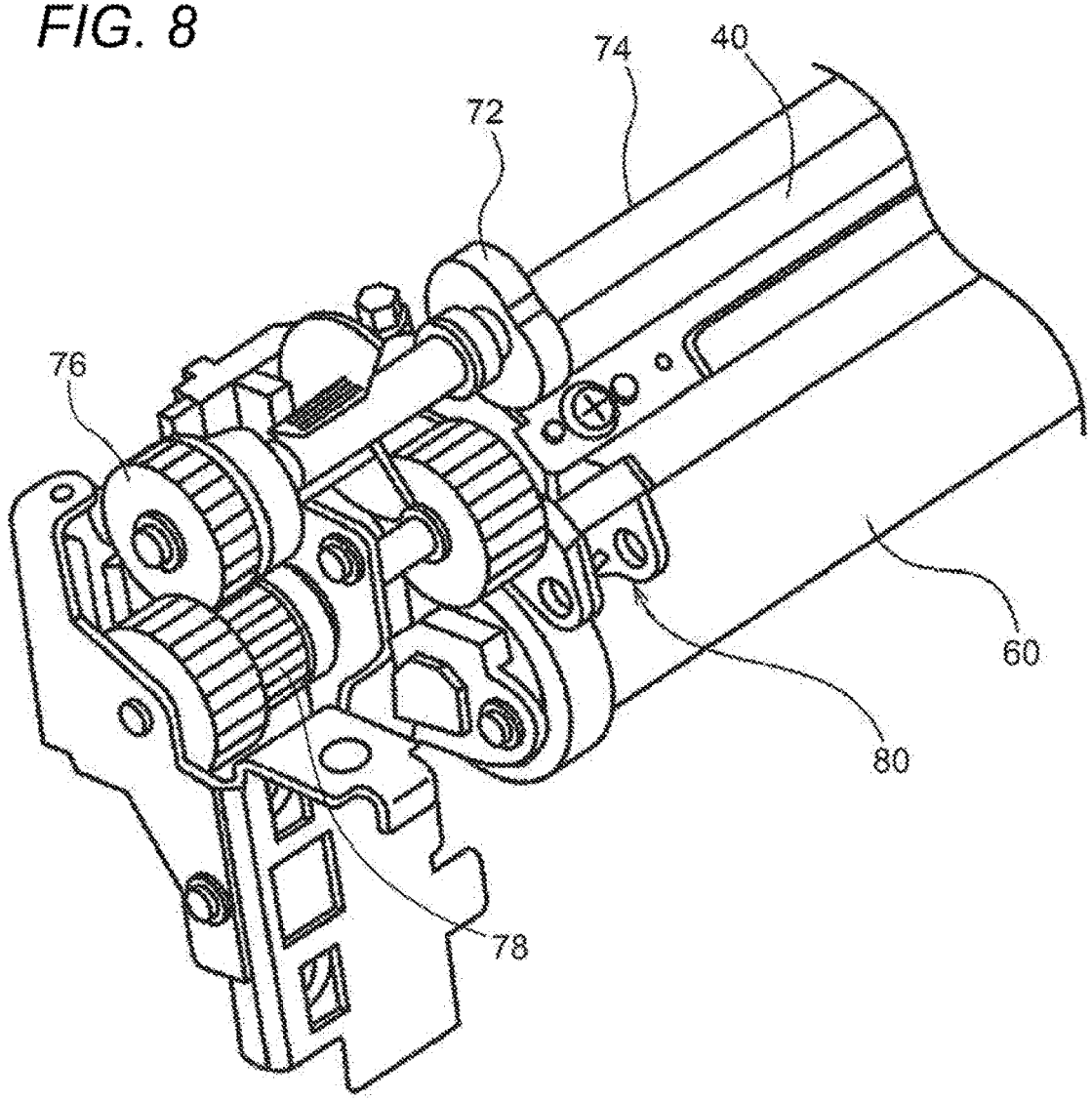
FIG. 8 is a perspective view showing the configuration of the contact mechanism according to the first exemplary embodiment.

(Contact Mechanism 70) The contact mechanism 70 shown in FIGS. 7 and 8 is a mechanism that causes the pressure roller 40 to be in contact with the heating belt 60. Specifically, the contact mechanism 70 moves the pressure roller 40 to the nip position shown in FIGS. 1, 4, 7, and 8, the central contact position shown in FIG. 5, and the separated position shown in FIG. 6.

More specifically, as shown in FIGS. 7 and 8, the contact mechanism 70 includes a pair of lever portions 80, a pair of cams 72, a camshaft 74, a camshaft gear 76, a transmission gear 78, and a driving unit 79 (see FIG. 7). In FIGS. 7 and 8, one lever portion 80 of the pair of lever portions 80 is shown, and one cam 72 of the pair of cams 72 is shown.

The pair of lever portions 80 are displacement portions that displace the pressure roller 40. The pair of lever portions 80 are respectively arranged on one end side and the other end side of the pressure roller 40 in the axial direction.

Specifically, as shown in FIG. 7, each of the lever portions 80 includes a lever 82, a support member 84, a spring portion 86, and cam followers 88.

One end portion of the lever 82 is rotatably supported by a device main body of the fixing device 16 by a fulcrum 82A disposed upstream of the pressure roller 40 in a transport direction (right side of FIG. 7).

The lever 82 extends obliquely upward from the fulcrum 82A toward a downstream side in the transport direction (left side of FIG. 7), is bent on an upper side of the pressure roller 40, and extends downstream in the transport direction (left side of FIG. 7) from a bent portion 82B. Each of the cam followers 88 is formed in a roller shape and is rotatably attached to the bent portion 82B of the lever 82.

The support member 84 rotatably supports the pressure roller 40. The support member 84 is provided at the other end portion of the lever 82 so as to be movable within a predetermined range in an approaching direction (lower side of FIG. 7) in which the pressure roller 40 approaches the heating belt 60 and an opposite direction thereof (upper side of FIG. 7).

The spring portion 86 is configured with a coil spring and is provided between the lever 82 and the support member 84. The spring portion 86 pushes the support member 84 in the approaching direction by an elastic force of the spring portion 86.

The camshaft 74 is a rotation shaft that extends along the axial direction of the pressure roller 40 on an upper side of the pressure roller 40 and the lever 82. The camshaft 74 is rotatably supported by the device main body of the fixing device 16.

Figure 9:
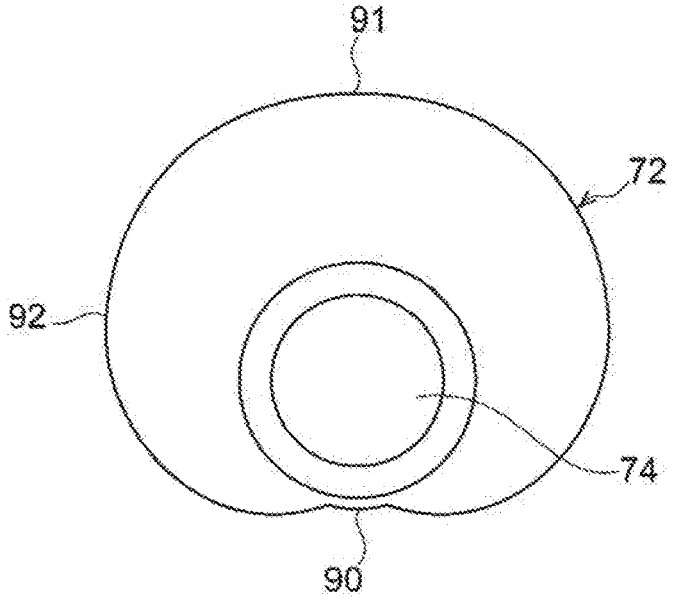
FIG. 9 is a schematic diagram showing a configuration of a cam according to the first exemplary embodiment.

The pair of cams 72 are respectively fixed to one end portion side and the other end portion side of the camshaft 74 in the axial direction. As shown in FIG. 9, each of the cams 72 includes a short diameter portion 90, a first long diameter portion 91 whose radial length from the camshaft 74 (that is, rotation center) is longer than that of the short diameter portion 90, and a second long diameter portion 92 whose radial length from the camshaft 74 is longer than that of the short diameter portion 90 and shorter than that of the first long diameter portion 91.

As shown in FIG. 7, the cams 72 are in contact with the cam followers 88. Contact positions of the cams 72 with respect to the cam followers 88 are changed depending on a rotation angle of the camshaft 74. The pair of cams 72 have the same shape.

The camshaft gear 76 is fixed to one end portion of the camshaft 74 in the axial direction. The transmission gear 78 is rotatably supported by the device main body of the fixing device 16 in a state of meshing with the camshaft gear 76.

The transmission gear 78 is driven to rotate by the driving unit 79. Specifically, as an example, the driving unit 79 is configured with a stepping motor that rotates the transmission gear 78 forward and backward.

Then, in the contact mechanism 70, the driving unit 79 rotates the transmission gear 78 (specifically, forward rotation and backward rotation), so that a driving force thereof is transmitted to the camshaft 74 via the camshaft gear 76, and the camshaft 74 and the cams 72 are rotated.

As one of the cams 72 is rotated, a contact position with respect to one of the cam followers 88 is changed among the short diameter portion 90, the first long diameter portion 91, and the second long diameter portion 92. When the short diameter portion 90 of the cam 72 is in contact with the cam follower 88, the pressure roller 40 is positioned at the separated position shown in FIG. 6. At the separated position, the pressure roller 40 is not in contact with the heating belt 60 from one end portion in the axial direction to the other end portion in the axial direction.

Figure 10:
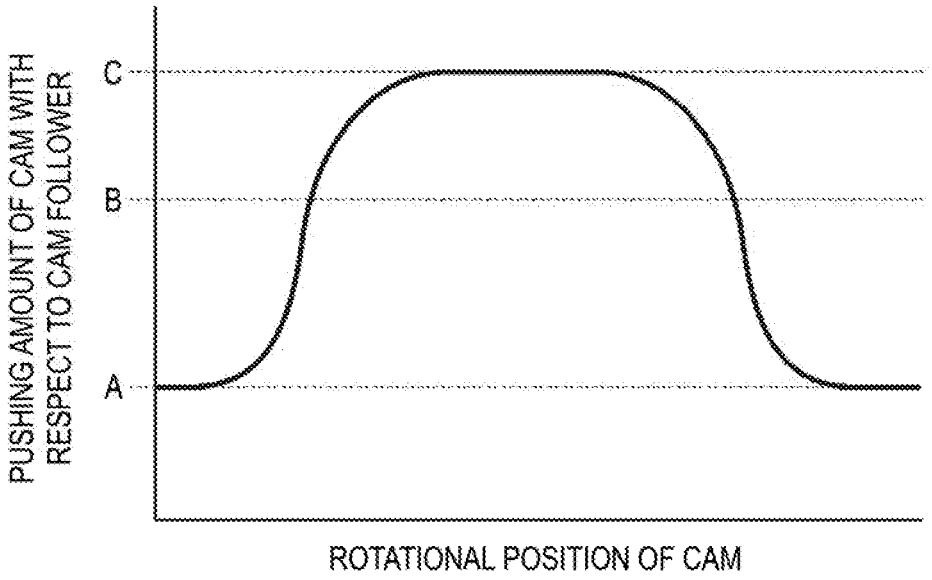
FIG. 10 is a graph showing a relationship between a rotational position of the cam according to the first exemplary embodiment and a pushing amount with respect to a cam follower.

When the short diameter portion 90 of the cam 72 is in contact with the cam follower 88, a pushing amount A of the cam 72 with respect to the cam follower 88 is minimized as shown in FIG. 10.

When the cam 72 is rotated and the first long diameter portion 91 of the cam 72 is in contact with the cam follower 88, the lever 82 is rotated around the fulcrum 82A, and the pressure roller 40 is moved to the nip position shown in FIG. 4. At the nip position, both end portions of the pressure roller 40 in the axial direction are pressurized toward a heating belt 60 side by the elastic force of the spring portion 86. Accordingly, the pressure roller 40 is bent along the convex shape of the heating belt 60. As a result, at the nip position, the pressure roller 40 is in contact with the heating belt 60 from one end portion in the axial direction to the other end portion in the axial direction, and the contact region 50S is formed.

When the first long diameter portion 91 of the cam 72 is in contact with the cam follower 88, a pushing amount C of the cam 72 with respect to the cam follower 88 is maximized as shown in FIG. 10.

Figure 5:
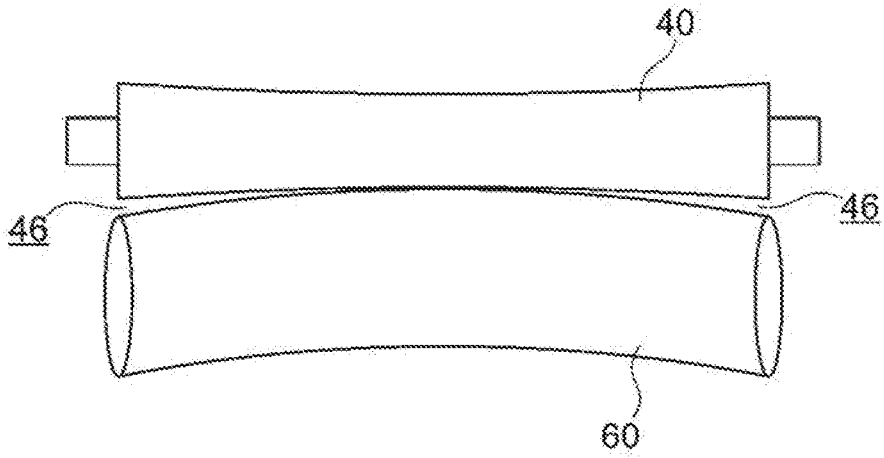
FIG. 5 is a schematic diagram showing a state where the pressure roller according to the first exemplary embodiment is positioned at a central contact position.
Figure 6:
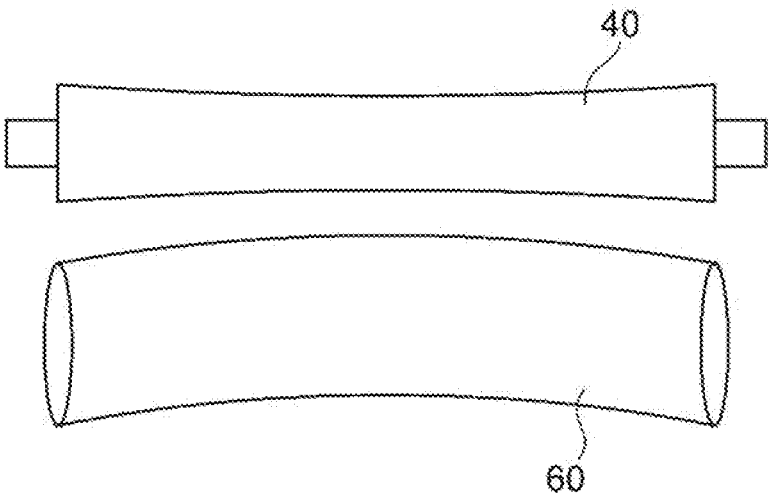
FIG. 6 is a schematic diagram showing a state where the pressure roller according to the first exemplary embodiment is positioned at a separated position.

Further, when the cam 72 is rotated and the second long diameter portion 92 of the cam 72 is in contact with the cam follower 88, the lever 82 is rotated around the fulcrum 82A, and the pressure roller 40 is moved to the central contact position shown in FIG. 5. At the central contact position, the pressure roller 40 is in contact with the heating belt 60 at the central portion in the axial direction, and a range of contact with the heating belt 60 at both end portions in the axial direction is smaller than a range of contact at the central portion in the axial direction. Specifically, at the central contact position, the pressure roller 40 is in contact with the heating belt 60 at the central portion in the axial direction, and the pressure roller 40 is not in contact with the heating belt 60 at both end portions in the axial direction.

In other words, at the central contact position, the pressure roller 40 is in contact with the heating belt 60 at the central portion in the axial direction, and spaces 46 are formed between both end portions of the pressure roller 40 in the axial direction and both end portions of the heating belt 60 in the axial direction.

When the second long diameter portion 92 of the cam 72 is in contact with the cam follower 88, a pushing amount B of the cam 72 with respect to the cam follower 88 is an intermediate value between the pushing amount A and the pushing amount C as shown in FIG. 10. Therefore, at the central contact position, the pressure roller 40 is moved further away from the heating belt 60 than at the nip position and is closer to the heating belt 60 than at the separated position.

The configuration in which the range of contact with the heating belt 60 at both end portions in the axial direction is smaller than the range of contact at the central portion in the axial direction is a concept including a configuration in which the range of contact is 0 (zero) as described above.

As described above, the contact mechanism 70 causes the pressure roller 40 to be in contact with or separate from the heating belt 60. In other words, the contact mechanism 70 may also be referred to as a mechanism that displaces the pressure roller 40 such that a distance between a rotation shaft of the pressure roller 40 and a rotation shaft of the heating belt 60 is changed.

Figure 11:
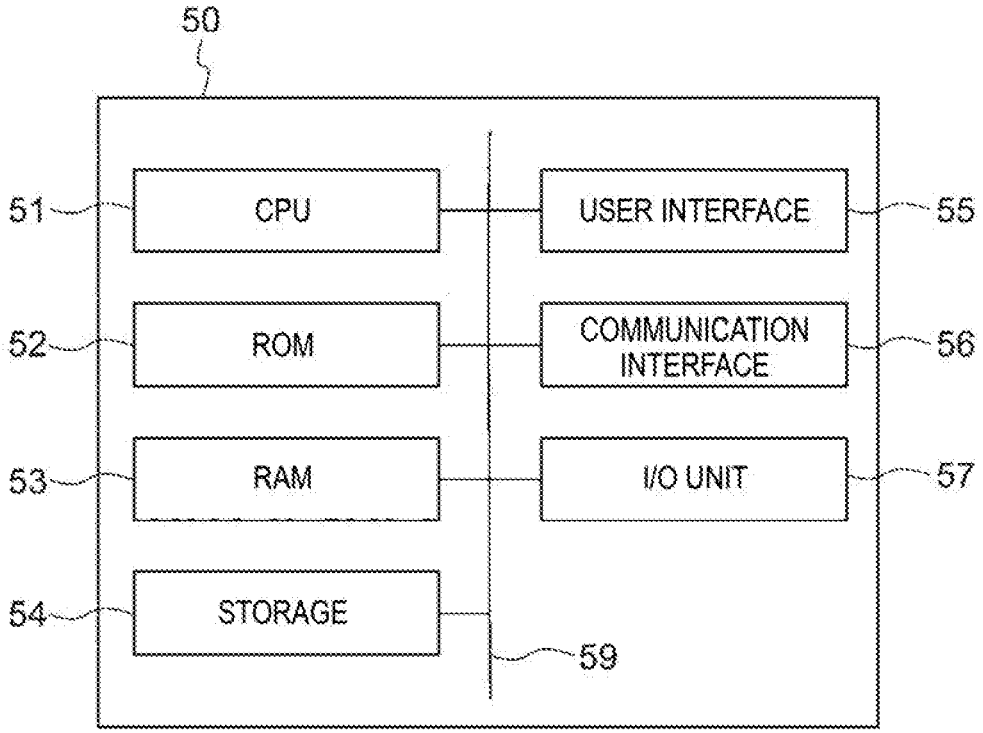
FIG. 11 is a block diagram showing a hardware configuration of a control device according to the first and fourth exemplary embodiments.

(Control Device 50) The control device 50 is a device that controls operation of units including the driving unit 79 of the fixing device 16. In the present exemplary embodiment, the control device 50 is configured as a device that controls operation of units of the image forming apparatus 10. The control device 50 may be configured as a device that controls at least operation of the driving unit 79. FIG. 11 is a block diagram showing a hardware configuration of the control device 50.

As shown in FIG. 11, the control device 50 has a function as a computer and includes a central processing unit (CPU: processor) 51, a read only memory (ROM) 52, a random access memory (RAM) 53, a storage 54, a user interface 55, a communication interface 56, and an I/O unit 57. Units of the control device 50 are communicably connected to each other via a bus 59.

The CPU 51 is a central arithmetic processing unit. The CPU 51 executes various programs and controls each unit. That is, the CPU 51 reads the programs from the ROM 52 or the storage 54 and executes the programs using the RAM 53 as a work region. The CPU 51 performs control of the units of the image forming apparatus 10 and various arithmetic processings in accordance with the programs stored in the ROM 52 or the storage 54.

The ROM 52 stores various programs and various pieces of data. The RAM 53 temporarily stores a program or data as a work region. The storage 54 is configured with a storage unit such as a hard disk drive (HDD) or a solid state drive (SSD), and stores various programs including an operating system and various pieces of data.

The user interface 55 is an interface when a user uses the image forming apparatus 10. The user interface 55 includes, for example, an input unit such as a button or a touch panel, and a display unit such as a liquid crystal display. The user is an instructor who instructs execution of a job.

The communication interface 56 is an interface for communicating with a user terminal such as a personal computer. Wired or wireless communication is used as a communication method of the communication interface 56. For example, Ethernet (registered trademark), FDDI, or Wi-Fi (registered trademark) is used as a communication standard of the communication interface 56. The I/O unit 57 connects the CPU 51 to the units of the image forming apparatus 10.

Figure 12:
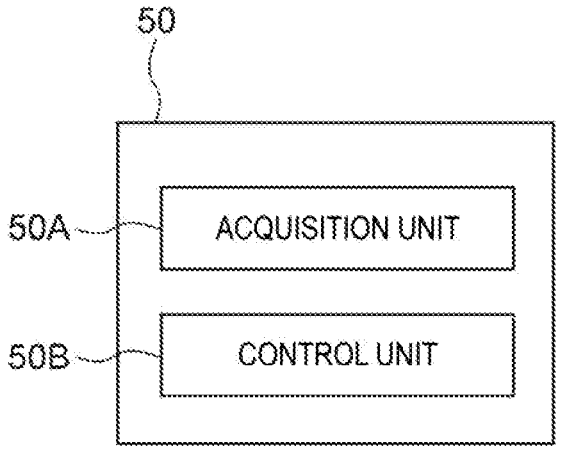
FIG. 12 is a block diagram showing an example of a functional configuration of the control device according to the first and fourth exemplary embodiments.

When the programs are executed, the control device 50 uses the hardware resources so as to implement various functions. Functional configurations implemented by the control device 50 will be described. FIG. 12 is a block diagram showing an example of the functional configurations of the control device 50.

As shown in FIG. 12, the control device 50 includes, as the functional configurations, an acquisition unit 50A and a control unit 50B. The functional configurations are implemented by the CPU 51 reading and executing control programs stored in the ROM 52 or the storage 54.

The acquisition unit 50A acquires an execution instruction to execute a job and job information related to the job. The acquisition unit 50A acquires, as the job information related to a job, information such as a size (specifically, a transport direction dimension and a width direction dimension), the number of sheets, and a transport speed of the recording medium P2 designated in the job. The term job refers to a processing unit of image forming operation to be executed by a single instruction by an instructor. Further, the instructor designates the size, the number of sheets, the transport speed, and the like of the recording medium P2 in the job.

As an example, a job execution instruction is input through the user terminal that is communicatable with the communication interface 56, and the acquisition unit 50A acquires the job execution instruction. Further, a job may be generated by reading a document with a reading device (specifically, a scanner), and the acquisition unit 50A may acquire the job execution instruction.

When the acquisition unit 50A acquires the job execution instruction, the control unit 50B controls the units of the image forming apparatus 10 including the fixing device 16 to execute the job. At this time, the control unit 50B controls units of the fixing device 16 including the driving unit 42 to heat the heating belt 60 and rotate the pressure roller 40. Further, the control unit 50B controls the driving unit 79 (see FIG. 7) of the contact mechanism 70 of the fixing device 16 to position the pressure roller 40 at the nip position (see FIG. 4).

When execution of the job is completed, the control unit 50B controls driving of the driving unit 79 such that the pressure roller 40 is positioned at the separated position. At this time, the control unit 50B controls units of the fixing device 16 including the driving unit 42 to stop heating of the heating belt 60 and rotation of the pressure roller 40.

Further, when the acquisition unit 50A continuously acquires a plurality of jobs, the control unit 50B controls driving of the driving unit 79 such that the pressure roller 40 is positioned at the central contact position (see FIG. 5) during a job interval. At this time, the control unit 50B controls units of the fixing device 16 including the driving unit 42 to maintain heating of the heating belt 60 and rotation of the pressure roller 40 during the job interval.

Figure 13:
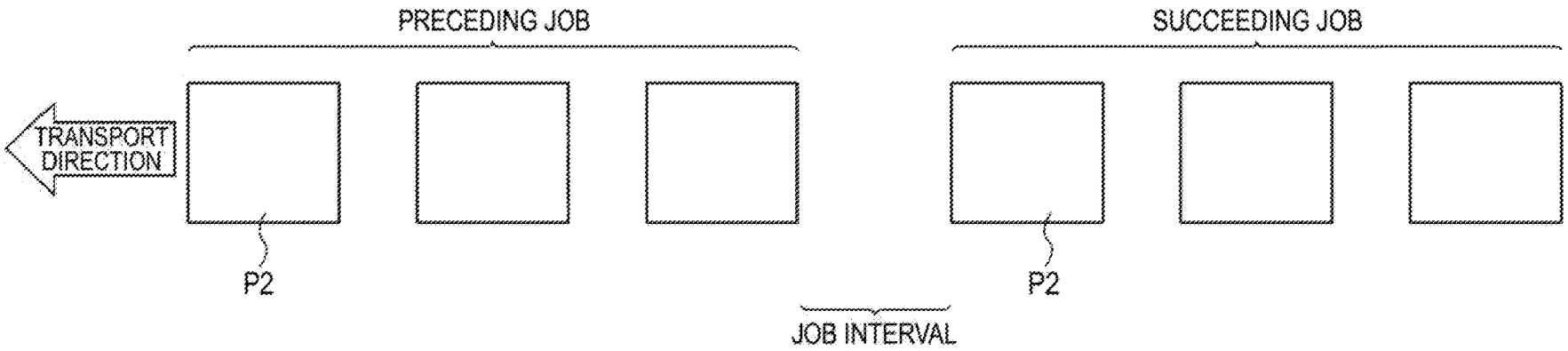
FIG. 13 is a diagram for illustrating concepts of a preceding job, a succeeding job, and a job interval when a plurality of jobs are executed in the image forming apparatus according to the first and fourth exemplary embodiments.

A case where jobs are continuously acquired corresponds to, for example, a case where another job is acquired before execution of one job is completed. As shown in FIG. 13, among the plurality of jobs continuously acquired by the acquisition unit 50A, a job to be executed first is referred to as a preceding job, and a job to be executed next to the preceding job is referred to as a succeeding job. Further, a period between the preceding job and the succeeding job is referred to as a job interval.

Here, the job interval is a state where the recording medium P2 does not exist in the contact region 50S. That is, in a state where the recording medium P2 does not exist during the job interval after the recording medium P2 passes through between the pressure roller 40 and the heating belt 60 (hereinafter, referred to as non-existence state), the control unit 50B controls the driving unit 79 to position the pressure roller 40 at the central contact position.

(Functions According to First Exemplary Embodiment) Next, functions according to the first exemplary embodiment will be described.

According to the image forming apparatus 10 of the first exemplary embodiment, when the acquisition unit 50A acquires the job execution instruction, the control unit 50B (see FIG. 12) of the control device 50 controls units of the image forming apparatus 10 to execute a job. At this time, the control unit 50B controls units of the fixing device 16 including the driving unit 42 to heat the heating belt 60 and rotate the pressure roller 40. Further, the control unit 50B controls the driving unit 79 of the contact mechanism 70 of the fixing device 16 to position the pressure roller 40 at the nip position (see FIG. 4).

Accordingly, the contact mechanism 70 moves the pressure roller 40 from the separated position to the nip position. As a result, both end portions of the pressure roller 40 in the axial direction are pressurized toward the heating belt 60 side, and the pressure roller 40 is bent along the convex shape of the heating belt 60. Accordingly, the contact region 50S is formed between the pressure roller 40 and the heating belt 60.

The forming unit 14 forms an image on the recording medium P1 transported by the first transport unit 11 shown in FIG. 1. The recording medium P1 on which the image is formed is transported to the contact region 50S by the first transport unit 11.

The recording medium P2 is transported to the contact region 50S by the second transport unit 12 at a timing at which the image formed on the recording medium P1 is transported to the contact region 50S.

Then, the fixing device 16 pressurizes and heats the recording medium P1 and the recording medium P2 while the recording medium P1 and the recording medium P2 are sandwiched and transported between the pressure roller 40 and the heating belt 60, and then fixes the image of the recording medium P1 onto the recording medium P2.

When the recording medium P2 is heated between the pressure roller 40 and the heating belt 60, the pressure roller 40 is maintained in a state of being in contact with the heating belt 60 while being bent along the convex shape of the heating belt 60. That is, in the present exemplary embodiment, in a heating state where the recording medium P2 is heated between the pressure roller 40 and the heating belt 60, the contact mechanism 70 pressurizes both end portions of the pressure roller 40 in the axial direction toward the heating belt 60 side so as to bend the pressure roller 40 along the convex shape of the heating belt 60.

Then, in the present exemplary embodiment, when the acquisition unit 50A continuously acquires the plurality of jobs, the control unit 50B controls driving of the driving unit 79 of the contact mechanism 70 such that the pressure roller 40 is positioned at the central contact position (see FIG. 5) during the job interval between the preceding job and the succeeding job. At this time, the control unit 50B controls units of the fixing device 16 including the driving unit 42 to maintain heating of the heating belt 60 and rotation of the pressure roller 40 during the job interval.

Accordingly, in the non-existence state, the contact mechanism 70 causes the pressure roller 40 to be in contact with the heating belt 60, which heats the pressure roller 40, at the central portion in the axial direction, and causes the pressure roller 40 not to be in contact with the heating belt 60 at both end portions of the pressure roller 40 in the axial direction (hereinafter, the above operation is referred to as recovery operation). Accordingly, the central portion of the pressure roller 40 in the axial direction is heated by the heating belt 60, and both end portions of the pressure roller 40 in the axial direction are not heated.

Here, when a plurality of jobs are consecutive, there may be a case in which a recording medium P2 having a width direction dimension smaller than a belt width direction dimension of the contact region 50S (hereinafter, referred to as small-sized recording medium P2) is used in the preceding job, and a recording medium P2 having a width direction dimension larger than the width direction dimension of the recording medium P2 used in the preceding job (hereinafter, referred to as large-sized recording medium P2) is used in the succeeding job (see FIG. 17). The width direction dimension of the recording medium P2 used in the succeeding job is, for example, equal to the belt width direction dimension of the contact region 50S (specifically, a dimension slightly smaller than the belt width direction dimension of the contact region 50S).

In the preceding job, when the small-sized recording medium P2 passes through the contact region 50S, heat of the heating belt 60 is transmitted to the pressure roller 40 via the recording medium P2 at the central portion in the belt width direction. On the other hand, at both end portions of the heating belt 60 in the belt width direction, the heat of the heating belt 60 is transmitted to the pressure roller 40 without passing through the recording medium P2. Therefore, as indicated by broken lines in FIG. 14, a temperature is lower at the central portion of the pressure roller 40 in the axial direction than at both end portions in the axial direction.

Then, in the non-existence state (that is, during the job interval), in a configuration in which a range of contact between the pressure roller 40 and the heating belt 60 is the same at a central portion in an axial direction and at both end portions in the axial direction (hereinafter, referred to as first configuration), a state where the temperature at the central portion of the pressure roller 40 in the axial direction is lower than the temperature at both end portions in the axial direction (state indicated by the broken lines in FIG. 14) is maintained even in the succeeding job.

Accordingly, when temperature unevenness occurs in the axial direction of the pressure roller 40, due to thermal expansion at both end portions of the pressure roller 40 in the axial direction, an outer diameter difference between both end portions in the axial direction and the central portion in the axial direction of the pressure roller 40 is increased. As a result, in the succeeding job, when the large-sized recording medium P2 passes through the contact region 50S, the feed speed of the recording medium P2 may become too high at both end portions in the width direction as compared with at the central portion, and a wrinkle may occur on the recording medium P2.

Further, when the temperature unevenness in the axial direction of the pressure roller 40 occurs, fixing unevenness of an image may occur in a width direction of the recording medium P2 in the succeeding job.

Figure 14:
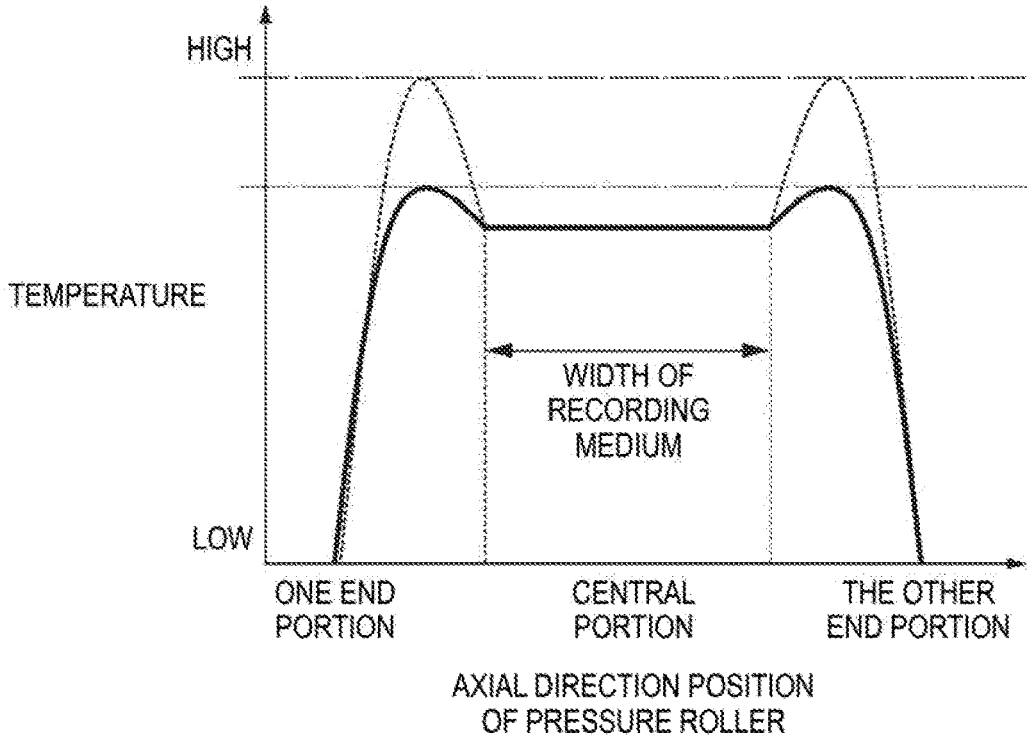
FIG. 14 is a graph showing a relationship between an axial direction position and a temperature of the pressure roller according to the first exemplary embodiment.

On the contrary, in the recovery operation of the present exemplary embodiment, since the central portion of the pressure roller 40 in the axial direction is heated by the heating belt 60 and both end portions of the pressure roller 40 in the axial direction are not heated during the job interval, after the recording medium P2 passes through between the central portion of the pressure roller 40 in the axial direction and the central portion of the heating belt 60 in the axial direction, the temperature unevenness in the axial direction of the pressure roller is reduced in a shorter time as compared with the first configuration. That is, a temperature distribution indicated by a solid line in FIG. 14 is restored in a short time.

Accordingly, according to the configuration of the present exemplary embodiment, since the temperature unevenness in the axial direction of the pressure roller is reduced in a short time, as compared with the first configuration, a wrinkle of the recording medium P2 due to the outer diameter difference between both end portions of the pressure roller 40 in the axial direction and the central portion of the pressure roller 40 in the axial direction is prevented in the succeeding job. Further, according to the configuration of the present exemplary embodiment, as compared with the first configuration, the fixing unevenness of the image that occurs in the width direction of the recording medium P2 is prevented in the succeeding job. Accordingly, according to the configuration of the present exemplary embodiment, as compared with the first configuration, a defect of the image formed on the recording medium P2 is prevented in the succeeding job.

Particularly, in the recovery operation of the present exemplary embodiment, the pressure roller 40 is not in contact with the heating belt 60 at both end portions in the axial direction during the job interval. Therefore, during the job interval, as compared with a configuration in which the pressure roller 40 is in contact with the heating belt 60

(hereinafter, referred to as second configuration), after the recording medium P2 passes through between the central portion of the pressure roller 40 in the axial direction and the central portion of the heating belt 60 in the axial direction, the temperature unevenness in the axial direction of the pressure roller is reduced in a short time.

More specifically, in the recovery operation of the present exemplary embodiment, the spaces 46 (see FIG. 5) are formed between both end portions of the pressure roller 40 in the axial direction and both end portions of the heating belt 60 in the axial direction during the job interval. Therefore, as compared with the second configuration, air easily flows between both end portions of the pressure roller 40 in the axial direction and both end portions of the heating belt 60 in the axial direction, and after the recording medium P2 passes through between the central portion of the pressure roller 40 in the axial direction and the central portion of the heating belt 60 in the axial direction, the temperature unevenness in the axial direction of the pressure roller is reduced in a short time.

In the present exemplary embodiment, the entire heating belt 60 is formed in the convex shape toward the pressure roller 40 side (that is, the upper side) at the central portion in the belt width direction. The pressure roller 40 is moved further away from the heating belt 60 at the central contact position than at the nip position, so that the pressure roller 40 is not in contact with the heating belt 60 at both end portions in the axial direction while a contact with the heating belt 60 at the central portion in the axial direction is maintained.

Accordingly, in the present exemplary embodiment, since the heating belt 60 is formed in the convex shape toward the pressure roller 40 side at the central portion in the belt width direction, by a distance by which the pressure roller 40 is moved away from the heating belt 60, a range of contact between the pressure roller 40 and the heating belt 60 at the central portion in the axial direction may be adjusted.

In the present exemplary embodiment, the recessed dimension (see FIG. 3) of the central portion of the pressure roller 40 in the axial direction is smaller than the protruding dimension (see FIG. 2) toward the pressure roller 40 side at the central portion of the heating belt 60 in the axial direction. Therefore, as compared with a configuration in which a recessed dimension is larger than a protruding dimension, it is easy to make the range of contact between the pressure roller 40 and the heating belt 60 at both end portions in the axial direction smaller than the range of contact at the central portion in the axial direction during the job interval.

In the present exemplary embodiment, in the heating state where the recording medium P2 is heated between the pressure roller 40 and the heating belt 60, the contact mechanism 70 pressurizes both end portions of the pressure roller 40 in the axial direction toward the heating belt 60 side, so that the pressure roller 40 is bent along the convex shape of the heating belt 60.

Therefore, as compared with a configuration in which a state where the pressure roller 40 is along an axial direction is maintained, fixing unevenness of an image on a recording medium in the heating state is prevented in the configuration in which the heating belt 60 is formed in the convex shape toward the pressure roller 40 side at the central portion in the axial direction.

Second Exemplary Embodiment

Next, a second exemplary embodiment will be described. The same components as those in the first exemplary embodiment are denoted by the same reference numerals, and description thereof is omitted as appropriate.

In the first exemplary embodiment, at the central contact position (see FIG. 5), the pressure roller 40 is in contact with the heating belt 60 at the central portion in the axial direction, and the pressure roller 40 is not in contact with the heating belt 60 at both end portions in the axial direction. In contrast thereto, the second exemplary embodiment is configured as follows.

Figure 15:
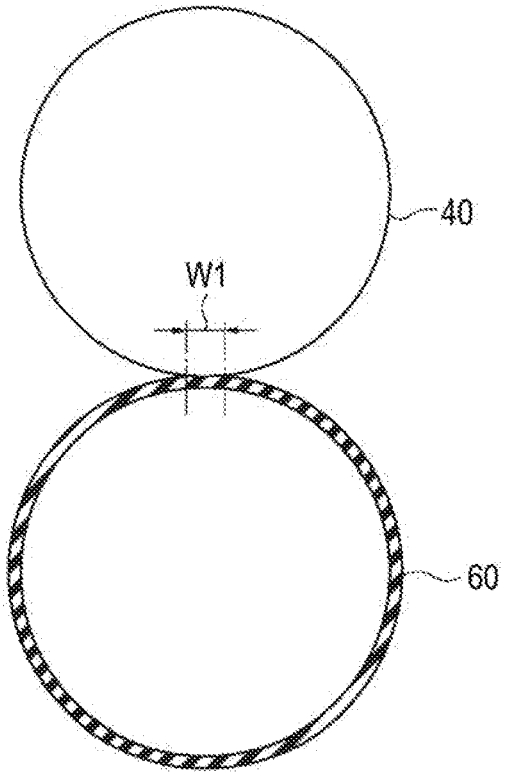
FIG. 15 is a schematic diagram showing a contact state with a heating belt at both end portions in an axial direction when a pressure roller according to a second exemplary embodiment is positioned at the central contact position.
Figure 16:
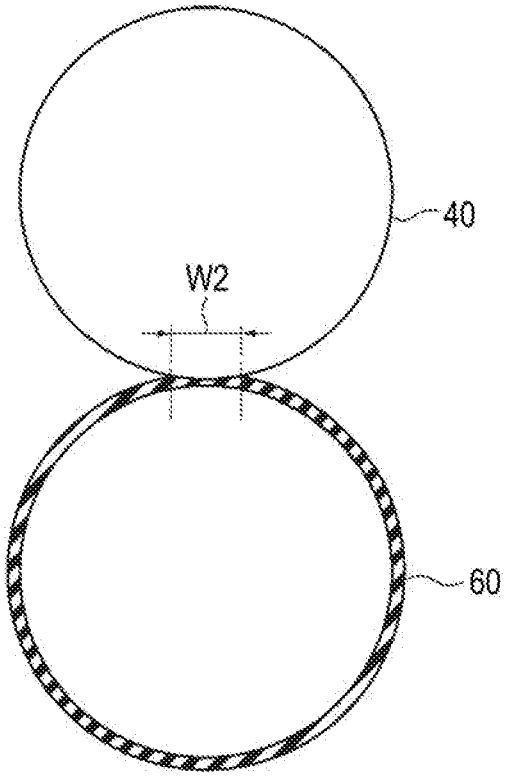
FIG. 16 is a schematic diagram showing a contact state with the heating belt at a central portion in an axial direction when the pressure roller according to the second exemplary embodiment is positioned at the central contact position.

That is, in the second exemplary embodiment, at a central contact position, the pressure roller 40 is in contact with the heating belt 60 at a central portion in an axial direction, and is in contact with the heating belt 60 at both end portions in the axial direction such that a range of contact with the heating belt 60 is smaller than a range of contact at the central portion in the axial direction. Specifically, in the pressure roller 40, at the central contact position, a contact width W1 (see FIG. 15) of both end portions in the axial direction in a rotation direction to the heating belt 60 (that is, circumferential direction) is smaller than a contact width W2 (see FIG. 16) of the central portion in the axial direction.

Hereinafter, functions of the second exemplary embodiment will be described.

In the present exemplary embodiment, when the acquisition unit 50A continuously acquires a plurality of jobs, the control unit 50B controls driving of the driving unit 79 of the contact mechanism 70 such that the pressure roller 40 is positioned at the central contact position during a job interval. At this time, the control unit 50B controls units of the fixing device 16 including the driving unit 42 to maintain heating of the heating belt 60 and rotation of the pressure roller 40 during the job interval.

Accordingly, in the non-existence state, the contact mechanism 70 causes the pressure roller 40 to be in contact with the heating belt 60, which heats the pressure roller 40, at the central portion in the axial direction, and makes a contact width of the pressure roller 40 in a rotation direction to the heating belt 60 smaller at both end portions in the axial direction than at the central portion in the axial direction.

Accordingly, a heating amount of both end portions of the pressure roller 40 in the axial direction is smaller than a heating amount of the central portion of the pressure roller 40 in the axial direction.

Therefore, after the recording medium P2 passes through between the central portion of the pressure roller 40 in the axial direction and the central portion of the heating belt 60 in the axial direction, as compared with the above-described first configuration, temperature unevenness in the axial direction of the pressure roller is reduced in a short time.

Accordingly, according to the configuration of the present exemplary embodiment, since the temperature unevenness in the axial direction of the pressure roller is reduced in a short time, as compared with the first configuration, a wrinkle of the recording medium P2 due to an outer diameter difference between both end portions of the pressure roller 40 in the axial direction and the central portion of the pressure roller 40 in the axial direction is prevented in the succeeding job. Further, according to the configuration of the present exemplary embodiment, as compared with the first configuration, fixing unevenness of an image that occurs in a width direction of the recording medium P2 is prevented in the succeeding job. Accordingly, according to the configuration of the present exemplary embodiment, as compared with the first configuration, a defect of the image formed on the recording medium P2 is prevented in the succeeding job.

In a recovery operation of the present exemplary embodiment, during the job interval, since the pressure roller 40 is in contact with the heating belt 60 at the central portion and both end portions in the axial direction, one of the pressure roller 40 and the heating belt 60 is supported by the other. Therefore, during the job interval, as compared with a configuration in which the pressure roller 40 is not in contact with the heating belt 60 at both end portions in an axial direction, an angle of one of the pressure roller 40 and the heating belt 60 with respect to the other does not easily change.

In the recovery operation of the present exemplary embodiment, since the pressure roller 40 is in contact with the heating belt 60 at the central portion and both end portions in the axial direction during the job interval, as compared with a configuration in which the pressure roller 40 is not in contact with the heating belt 60 at both end portions in an axial direction during a job interval, the heating belt 60 is stably rotated following the pressure roller 40.

Third Exemplary Embodiment

Next, a third exemplary embodiment will be described. The same components as those in the first exemplary embodiment are denoted by the same reference numerals, and description thereof is omitted as appropriate.

In the first exemplary embodiment, as described above, when the acquisition unit 50A continuously acquires the plurality of jobs, the control unit 50B controls the driving unit 79 to position the pressure roller 40 at the central contact position during the job interval. In contrast thereto, the third exemplary embodiment is configured as follows.

Figure 17:
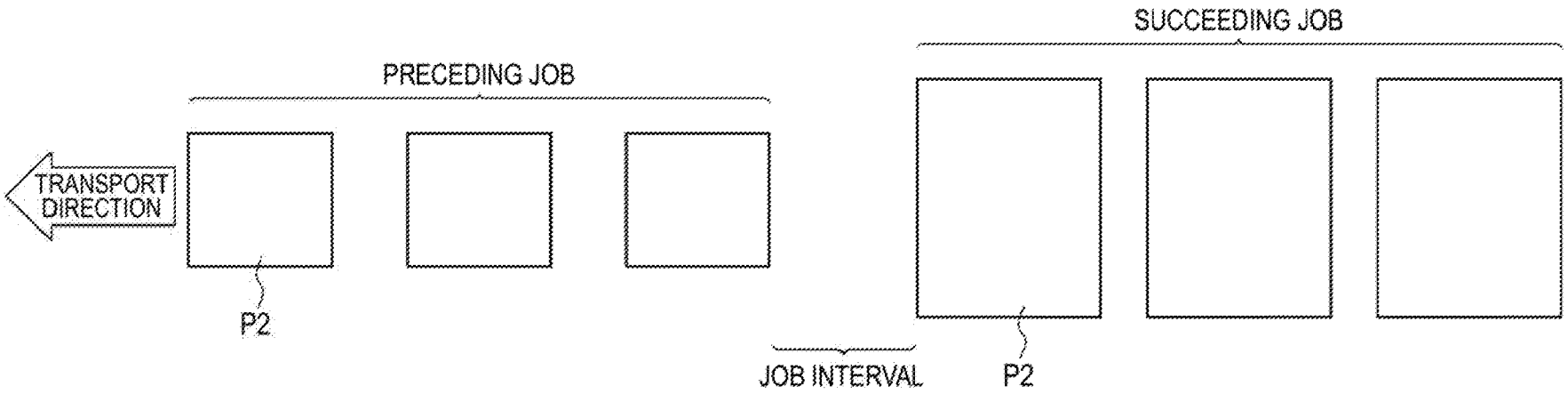
FIG. 17 is a schematic diagram showing a dimension difference of recording media between a preceding job and a succeeding job in an image forming apparatus according to third and sixth exemplary embodiments.

That is, in the third exemplary embodiment, when the acquisition unit 50A continuously acquires a plurality of jobs, as shown in FIG. 17, during a job interval in a case where a width direction dimension of a recording medium P2 used in a succeeding job is larger than a width direction dimension of a recording medium P2 used in a preceding job (hereinafter, referred to as "case where a dimension of a succeeding medium is large"), the control unit 50B controls the driving unit 79 to position the pressure roller 40 at a central contact position.

In other words, in a non-existence state between recording media P2 in a case where after a recording medium P2 passes through the contact region 50S, a recording medium P2 having a width direction dimension larger than that of the recording medium P2 is transported, a recovery operation is executed.

Accordingly, in the non-existence state, the contact mechanism 70 causes the pressure roller 40 to be in contact with the heating belt 60, which heats the pressure roller 40, at a central portion in an axial direction, and causes the pressure roller 40 not to be in contact with the heating belt 60 at both end portions of the pressure roller 40 in the axial direction. Accordingly, the central portion of the pressure roller 40 in the axial direction is heated by the heating belt 60, and both end portions of the pressure roller 40 in the axial direction are not heated.

In the present exemplary embodiment, when a width direction dimension of a recording medium P2 used in the succeeding job is smaller than a width direction dimension of a recording medium P2 used in the preceding job, no recovery operation is executed during a job interval thereof. Specifically, for example, the control unit 50B controls the driving unit 79 to position the pressure roller 40 at a separated position.

The control unit 50B specifies, for example, a width direction dimension of the recording medium P2 in job information. Further, the control unit 50B may specify the width direction dimension of the recording medium P2 based on a detection result of a detection unit such as a sensor.

Here, in the case where the dimension of the succeeding medium is large, the pressure roller 40 is in contact with the recording medium P2 at portions on both end sides in the axial direction in the succeeding job as compared with a case of the preceding job. Accordingly, when an outer diameter difference between both end portions of the pressure roller 40 in the axial direction and the central portion of the pressure roller 40 in the axial direction becomes large due to thermal expansion at both end portions of the pressure roller 40 in the axial direction, a feed speed of the recording medium P2 is likely to be faster at both end portions in a width direction than at the central portion.

Therefore, in the case where the dimension of the succeeding medium is large, with a configuration (hereinafter, referred to as third configuration) in which a range of contact between the pressure roller 40 and the heating belt 60 is the same at a central portion in an axial direction and both end portions in the axial direction and control is performed to position the pressure roller 40 at a central contact position, a wrinkle is likely to occur on the recording medium P2 in the succeeding job.

On the contrary, in the present exemplary embodiment, during a job interval in the case where the dimension of the succeeding medium is large, since the driving unit 79 is controlled to position the pressure roller 40 at the central contact position, an effect of preventing a wrinkle of a transported recording medium P2 is high as compared with the third configuration.

In the above-described third exemplary embodiment, although the recovery operation is executed in the case where the dimension of the succeeding medium is large, the present invention is not limited thereto. For example, as a result of executing the preceding job, when a temperature difference between the central portion of the pressure roller 40 in the axial direction and at least one of both end portions is equal to or larger than a predetermined threshold, a configuration in which the recovery operation is executed may be adopted. In this case, the recovery operation is executed based on, for example, information obtained by measuring temperatures of the central portion of the pressure roller 40 in the axial direction and both end portions of the pressure roller 40 in the axial direction by a detection unit such as a temperature sensor. Further, the temperature difference of the pressure roller 40 may be predicted based on the number of sheets of the recording media P2 on which a job is executed in the preceding job, and the recovery operation may be executed based on information thereof.

Fourth Exemplary Embodiment

Next, a fourth exemplary embodiment will be described. Since the image forming apparatus 10, the fixing device 16, and the heating belt 6 are configured in the same manner as in the first exemplary embodiment, description thereof will be omitted. As will be described later, the pressure roller 40 is moved to the contact position shown in FIGS. 1 and 4 (hereinafter, referred to as nip position), a first contact position shown in FIG. 18A, a second contact position shown in FIG. 18B, and the separated position shown in FIG. 6 by the contact mechanism 70, and other components have the same configurations as those of the first exemplary embodiment.

(Contact Mechanism 70)

Figure 18A:
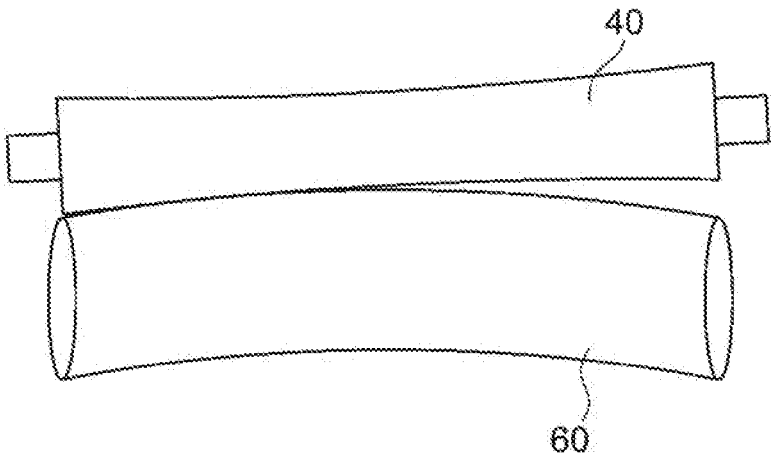
FIG. 18A is a schematic diagram showing a state where the pressure roller according to the fourth exemplary embodiment is positioned at a first contact position.
Figure 18B:
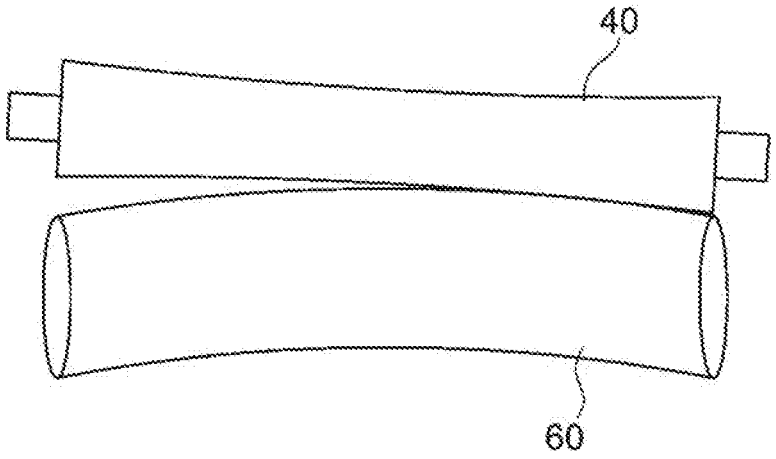
FIG. 18B is a schematic diagram showing a state where the pressure roller according to the fourth exemplary embodiment is positioned at a second contact position.
Figure 19:
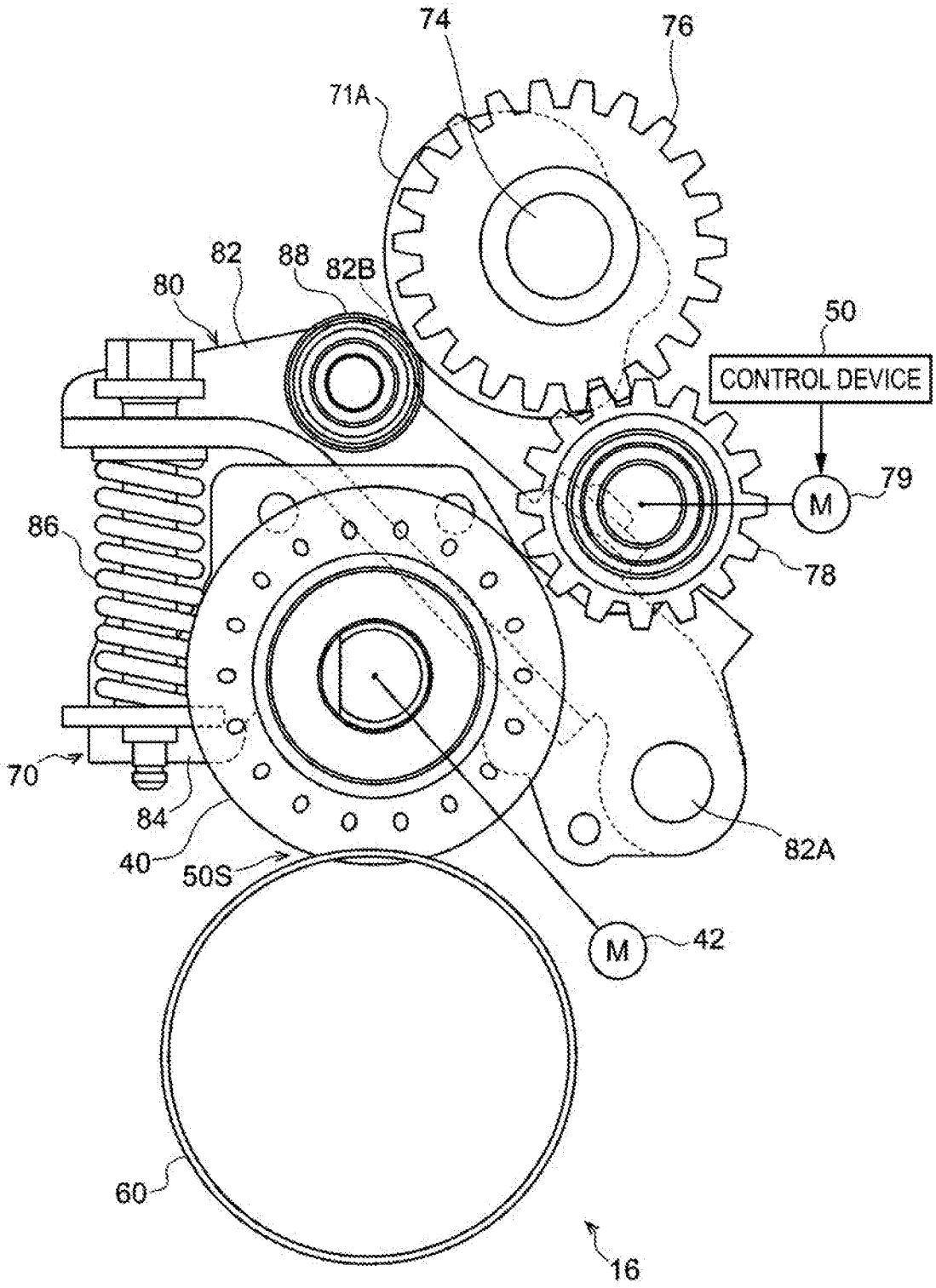
FIG. 19 is a front view showing a configuration of a contact mechanism according to the fourth exemplary embodiment.

The contact mechanism 70 shown in FIGS. 7 and 19 is a mechanism that causes the pressure roller 40 to be in contact with the heating belt 60. Specifically, the contact mechanism 70 moves the pressure roller 40 to the nip position shown in FIGS. 1, 4, 7, and 19, the first contact position shown in FIG. 18A, the second contact position shown in FIG. 18B, and the separated position shown in FIG. 6.

More specifically, as shown in FIGS. 7 and 19, the contact mechanism 70 includes the pair of lever portions 80, a first cam 71A, a second cam 72A, the camshaft 74, the camshaft gear 76, the transmission gear 78, and the driving unit 79 (see FIG. 7). In FIGS. 7 and 19, one lever portion 80 of the pair of lever portions 80 is shown, and the first cam 71A of the first cam 71A and the second cam 72A is shown.

The pair of lever portions 80 are displacement portions that displace the pressure roller 40. The pair of lever portions 80 are respectively arranged on one end portion side and the other end portion side of the pressure roller 40 in an axial direction. Specifically, as shown in FIG. 7, each of the lever portions 80 includes the lever 82, the support member 84, the spring portion 86, and the cam followers 88.

One end portion of the lever 82 is rotatably supported by a device main body of the fixing device 16 by the fulcrum 82A disposed upstream of the pressure roller 40 in a transport direction (right side of FIG. 7).

The lever 82 extends obliquely upward from the fulcrum 82A toward a downstream side in the transport direction (left side of FIG. 7), is bent on an upper side of the pressure roller 40, and extends downstream in the transport direction (left side of FIG. 7) from the bent portion 82B. Each of the cam followers 88 is formed in a roller shape and is rotatably attached to the bent portion 82B of the lever 82.

The support member 84 rotatably supports the pressure roller 40. The support member 84 is provided at the other end portion of the lever 82 so as to be movable within a predetermined range in an approaching direction (lower side of FIG. 7) in which the pressure roller 40 approaches the heating belt 60 and an opposite direction thereof (upper side of FIG. 7).

The spring portion 86 is configured with a coil spring and is provided between the lever 82 and the support member 84. The spring portion 86 pushes the support member 84 in the approaching direction by an elastic force of the spring portion 86.

The camshaft 74 is a rotation shaft that extends along an axial direction of the pressure roller 40 on an upper side of the pressure roller 40 and the lever 82. The camshaft 74 is rotatably supported by the device main body of the fixing device 16.

Figure 21:
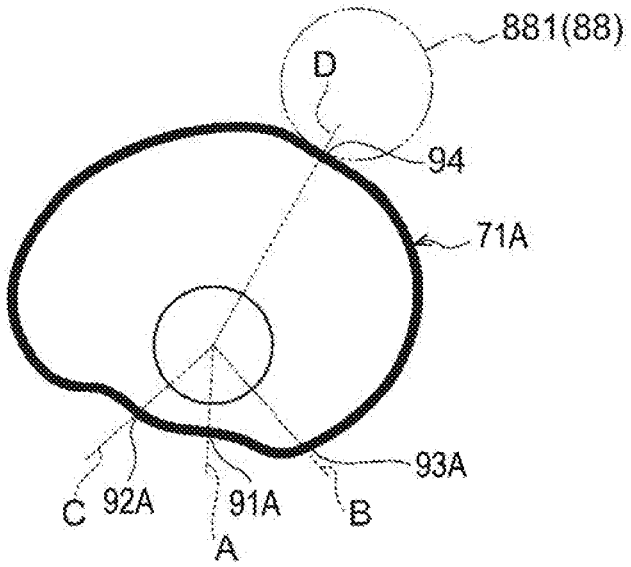
FIG. 21 is a schematic diagram showing a configuration of a cam according to the fourth exemplary embodiment.
Figure 22:
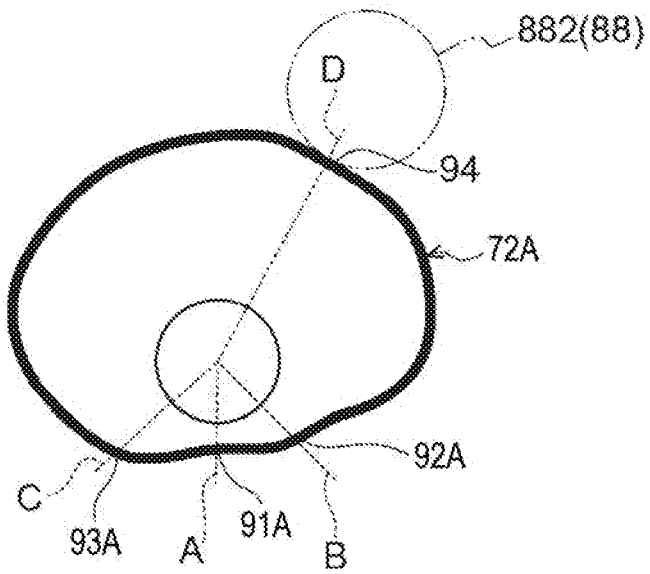
FIG. 22 is a graph showing a relationship between a rotational position of the cam according to the fourth exemplary embodiment and a pushing amount with respect to a cam follower.

The first cam 71A shown in FIG. 21 is fixed to one end portion side of the camshaft 74 in the axial direction. The second cam 72A shown in FIG. 22 is fixed to the other end portion side of the camshaft 74 in the axial direction. The first cam 71A and the second cam 72A are in contact with the cam followers 88, respectively. Specifically, the first cam 71A is in contact with a cam follower 88 disposed on one end portion side of the pressure roller 40 in the axial direction (hereinafter, may be referred to as cam follower 881), and the second cam 72A is in contact with a cam follower 88 disposed on the other end portion side of the pressure roller 40 in the axial direction (hereinafter, may be referred to as cam follower 882). The cam follower 881 is an example of a first contacted portion. The cam follower 882 is an example of a second contacted portion.

Figure 20:
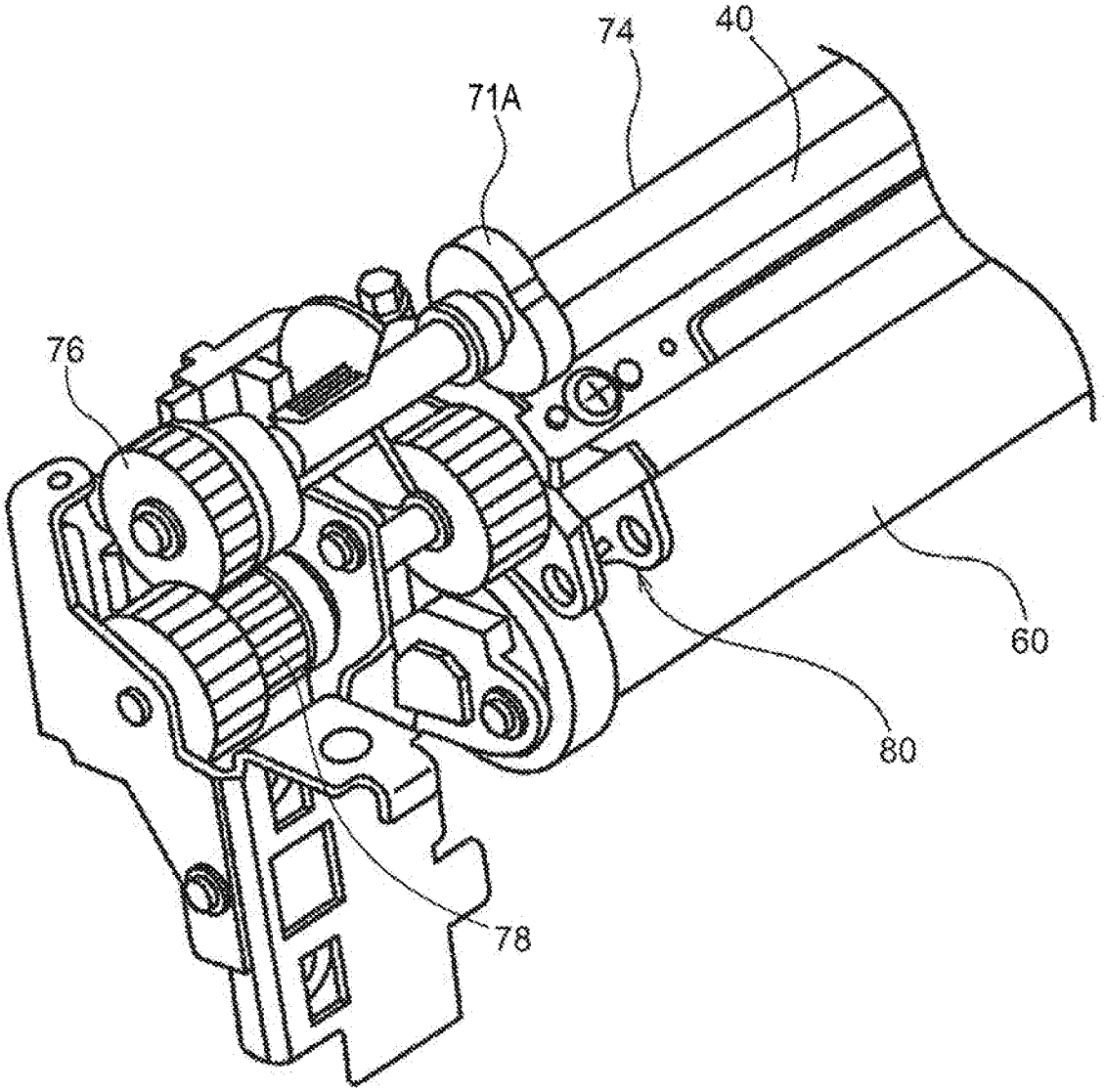
FIG. 20 is a perspective view showing the configuration of the contact mechanism according to the fourth exemplary embodiment.

As shown in FIGS. 20 and 21, each of the first cam 71A and the second cam 72A includes a first contact portion 91A, a second contact portion 92A, a third contact portion 93A, and a fourth contact portion 94A. As for the first contact portion 91A, the second contact portion 92A, the third contact portion 93A, and the fourth contact portion 94A, in this order, a length along a radial direction (hereinafter, referred to as radial length) of the camshaft 74 (that is, a rotation center) is increased. The second contact portion 92A is an example of a short diameter portion. The third contact portion 93A is an example of a long diameter portion.

In the first cam 71A, the first contact portion 91A, the second contact portion 92A, the fourth contact portion 94A, and the third contact portion 93A are arranged in this order in a clockwise direction of FIG. 21 with the first contact portion 91A as a reference. On the other hand, in the second cam 72A, the first contact portion 91A, the third contact portion 93A, the fourth contact portion 94A, and the second contact portion 92A are arranged in this order in a clockwise direction of FIG. 22 with the first contact portion 91A as a reference. Accordingly, in the second cam 72A, when viewed in the clockwise direction of FIG. 22, the third contact portion 93A is disposed between the first contact portion 91A and the fourth contact portion 94A, and the second contact portion 92A is disposed between the fourth contact portion 94A and the first contact portion 91A. Therefore, for example, as compared with a configuration in which both the third contact portion 93A and the second contact portion 92A are arranged between the first contact portion 91A and the fourth contact portion 94A, a change in an outer diameter of the second cam 72A from the first contact portion 91A to the fourth contact portion 94A and a change in an outer diameter of the second cam 72A from the fourth contact portion 94A to the first contact portion 91A may be suppressed to be small. In the first cam 71A, when viewed in the clockwise direction of FIG. 21, the second contact portion 92A is disposed between the first contact portion 91A and the fourth contact portion 94A, and the third contact portion 93A is disposed between the fourth contact portion 94A and the first contact portion 91A. Therefore, for example, as compared with a configuration in which both the third contact portion 93A and the second contact portion 92A are arranged between the first contact portion 91A and the fourth contact portion 94A, a change in an outer diameter of the first cam 71A from the first contact portion 91A to the fourth contact portion 94A, and a change in an outer diameter of the first cam 71A from the fourth contact portion 94A to the first contact portion 91A may be suppressed to be small. Accordingly, movement of the pressure roller 40 between the nip position and the separated position is smooth.

The first contact portion 91A of the first cam 71A and the first contact portion 91A of the second cam 72A are arranged at the same position in a circumferential direction of the camshaft 74. Further, the third contact portion 93A of the first cam 71A and the second contact portion 92A of the second cam 72A are arranged at the same position in the circumferential direction of the camshaft 74. The second contact portion 92A of the first cam 71A and the third contact portion 93A of the second cam 72A are arranged at the same position in the circumferential direction of the camshaft 74. The fourth contact portion 94A of the first cam 71A and the fourth contact portion 94A of the second cam 72A are arranged at the same position in the circumferential direction of the camshaft 74.

As described above, in the first cam 71A and the second cam 72A, arrangements of the first contact portion 91A, the second contact portion 92A, the third contact portion 93A, and the fourth contact portion 94A are different, so that the first cam 71A and the second cam 72A have different shapes.

Then, contact positions of the first cam 71A and the second cam 72A with respect to the cam followers 88 are switched depending on a rotation position of the camshaft 74. Specifically, the first contact portions 91A of the first cam 71A and the second cam 72A are in contact with the cam followers 88 at a predetermined reference rotation position (position A in FIGS. 20 and 21). Further, in the first cam 71A, the third contact portion 93A is in contact with the cam follower 881 at a first rotation position (position B in FIG. 21) obtained by rotating the first cam 71A by a predetermined angle from the reference rotation position. Further, in the first cam 71A, the second contact portion 92A is in contact with the cam follower 881 at a second rotation position (position C in FIG. 21) obtained by rotating the first cam 71A by a predetermined angle from the first rotation position. Furthermore, in the first cam 71A, the fourth contact portion 94A is in contact with the cam follower 881 at a third rotation position (position D in FIG. 21) obtained by rotating the first cam 71A by a predetermined angle from the second rotation position.

On the other hand, in the second cam 72A, the second contact portion 92A is in contact with the cam follower 882 at the first rotation position (position B in FIG. 22). Further, in the second cam 72A, the third contact portion 93A is in contact with the cam follower 882 at the second rotation position (position C in FIG. 22). Furthermore, in the second cam 72A, the fourth contact portion 94A is in contact with the cam follower 882 at the third rotation position (position D in FIG. 22).

The camshaft gear 76 is fixed to one end portion of the camshaft 74 in the axial direction. The transmission gear 78 is rotatably supported by the device main body of the fixing device 16 in a state of meshing with the camshaft gear 76.

The transmission gear 78 is driven to rotate by the driving unit 79. Specifically, as an example, the driving unit 79 is configured with a stepping motor that rotates the transmission gear 78 forward and backward.

Then, in the contact mechanism 70, the driving unit 79 rotates the transmission gear 78 (specifically, forward rotation and backward rotation), so that a driving force thereof is transmitted to the camshaft 74 via the camshaft gear 76 and the camshaft 74 is rotated.

When the camshaft 74 is rotated, as described above, the contact positions of the first cam 71A and the second cam 72A with respect to the cam followers 88 are changed among the first contact portion 91A, the second contact portion 92A, the third contact portion 93A, and the fourth contact portion 94A. The first contact portions 91A of the first cam 71A and the second cam 72A are in contact with the cam followers 88, so that the pressure roller 40 is positioned at the separated position shown in FIG. 6. At the separated position, the pressure roller 40 is not in contact with the heating belt 60 from one end portion in the axial direction to the other end portion in the axial direction.

When the camshaft 74 is rotated and the fourth contact portions 94A of the first cam 71A and the second cam 72A are in contact with the cam followers 88, the lever 82 is rotated around the fulcrum 82A and the pressure roller 40 is moved to the nip position shown in FIG. 4. At the nip position, both end portions of the pressure roller 40 in the axial direction are pressurized toward a heating belt 60 side by an elastic force of the spring portion 86. Accordingly, the pressure roller 40 is bent along a convex shape of the heating belt 60. As a result, at the nip position, the pressure roller 40 is in contact with the heating belt 60 from one end portion in the axial direction to the other end portion in the axial direction, and the contact region 50S is formed.

When the fourth contact portions 94A of the first cam 71A and the second cam 72A are in contact with the cam followers 88, a pushing amount of the first cam 71A and the second cam 72A with respect to the cam followers 88 becomes maximum.

When the camshaft 74 is rotated and the third contact portion 93A of the first cam 71A and the second contact portion 92A of the second cam 72A are in contact with the cam followers 88, the lever 82 is rotated around the fulcrum 82A, and the pressure roller 40 is moved to the first contact position shown in FIG. 18A. At the first contact position, the pressure roller 40 is in contact with the heating belt 60 at one end portion and a central portion in the axial direction, and a range of contact with the heating belt 60 at the other end portion in the axial direction is smaller than a range of contact at the central portion in the axial direction. Specifically, at the first contact position, the pressure roller 40 is in contact with the heating belt 60 at one end portion and the central portion in the axial direction, and is not in contact with the heating belt 60 at the other end portion in the axial direction.

In other words, at the first contact position, the pressure roller 40 is in contact with the heating belt 60 at one end portion and the central portion in the axial direction, and the space 46 is formed between the other end portion of the pressure roller 40 in the axial direction and the other end portion of the heating belt 60 in the axial direction.

Further, when the camshaft 74 is rotated and the second contact portion 92A of the first cam 71A and the third contact portion 93A of the second cam 72A are in contact with the cam followers 88, the lever 82 is rotated around the fulcrum 82A, and the pressure roller 40 is moved to the second contact position shown in FIG. 18B. At the second contact position, the pressure roller 40 is in contact with the heating belt 60 at the other end portion and the central portion in the axial direction, and a range of contact with the heating belt 60 at one end portion in the axial direction is smaller than a range of contact at the central portion in the axial direction. Specifically, at the second contact position, the pressure roller 40 is in contact with the heating belt 60 at the other end portion and the central portion in the axial direction, and is not in contact with the heating belt 60 at one end portion in the axial direction.

In other words, at the second contact position, the pressure roller 40 is in contact with the heating belt 60 at the other end portion and the central portion in the axial direction, and the space 46 is formed between one end portion of the pressure roller 40 in the axial direction and one end portion of the heating belt 60 in the axial direction.

A configuration in which a range of contact with the heating belt 60 at an end portion in an axial direction is smaller than a range of contact at a central portion in the axial direction is a concept including a configuration in which the range of contact is 0 (zero) as described above.

As described above, the contact mechanism 70 causes the pressure roller 40 to be in contact with or separate from the heating belt 60. In other words, the contact mechanism 70 may also be referred to as a mechanism that displaces the pressure roller 40 such that a distance between a rotation shaft of the pressure roller 40 and a rotation shaft of the heating belt 60 is changed.

(Control Device 50)

Regarding the control device 50, description of the same points in contents described in the first exemplary embodiment will be omitted. When the acquisition unit 50A continuously acquires a plurality of jobs, the control unit 50B controls driving of the driving unit 79 such that the pressure roller 40 is alternately positioned at the first contact position (see FIG. 18A) and the second contact position (see FIG. 18B) during a job interval.

A case where jobs are continuously acquired corresponds to, for example, a case where another job is acquired before execution of one job is completed. As shown in FIG. 13, among the plurality of jobs continuously acquired by the acquisition unit 50A, a job to be executed first is referred to as a preceding job, and a job to be executed next to the preceding job is referred to as a succeeding job. Further, a period between the preceding job and the succeeding job is referred to as a job interval.

Here, the job interval is a state where the recording medium P2 does not exist in the contact region 50S. That is, in a state where the recording medium P2 does not exist during the job interval after the recording medium P2 passes through between the pressure roller 40 and the heating belt 60 (hereinafter, referred to as non-existence state), the control unit 50B controls the driving unit 79 to alternately position the pressure roller 40 at the first contact position (see FIG. 18A) and the second contact position (see FIG. 18B). Specifically, in each of a state where the pressure roller 40 is positioned at the first contact position and a state where the pressure roller 40 is positioned at the second contact position (see FIG. 18B), the control unit 50B controls the driving unit 79 to rotate the pressure roller 40 a plurality of times.

More specifically, in each of the state where the pressure roller 40 is positioned at the first contact position and the state where the pressure roller 40 is positioned at the second contact position (see FIG. 18B), the control unit 508 controls the driving unit 79 to rotate the pressure roller 40 for the same rotation time. In each of the state where the pressure roller 40 is positioned at the first contact position and the state where the pressure roller 40 is positioned at the second contact position (see FIG. 18B), the control unit 50B may control driving of the driving unit 79 to rotate the heating belt 60 at the same number of rotations.

(Functions According to Fourth Exemplary Embodiment)

Next, functions according to the fourth exemplary embodiment will be described.

According to the image forming apparatus 10 of the fourth exemplary embodiment, when the acquisition unit 50A acquires a job execution instruction, the control unit 50B (see FIG. 12) of the control device 50 controls units of the image forming apparatus 10 to execute a job. At this time, the control unit 50B controls units of the fixing device 16 including the driving unit 42 to heat the heating belt 60 and rotate the pressure roller 40. Further, the control unit 50B controls the driving unit 79 of the contact mechanism 70 of the fixing device 16 to position the pressure roller 40 at the nip position (see FIG. 4).

Accordingly, the contact mechanism 70 moves the pressure roller 40 from the separated position to the nip position. As a result, both end portions of the pressure roller 40 in the axial direction are pressurized toward the heating belt 60 side, and the pressure roller 40 is bent along the convex shape of the heating belt 60. Accordingly, the contact region 50S is formed between the pressure roller 40 and the heating belt 60.

The forming unit 14 forms an image on the recording medium P1 transported by the first transport unit 11 shown in FIG. 1. The recording medium P1 on which the image is formed is transported to the contact region 50S by the first transport unit 11.

The recording medium P2 is transported to the contact region 50S by the second transport unit 12 at a timing at which the image formed on the recording medium P1 is transported to the contact region 50S.

Then, the fixing device 16 pressurizes and heats the recording medium P1 and the recording medium P2 while the recording medium P1 and the recording medium P2 are sandwiched and transported between the pressure roller 40 and the heating belt 60, and then fixes the image of the recording medium P1 onto the recording medium P2.

When the recording medium P2 is heated between the pressure roller 40 and the heating belt 60, the pressure roller 40 is maintained in a state of being in contact with the heating belt 60 while being bent along the convex shape of the heating belt 60. That is, in the present exemplary embodiment, in a heating state where the recording medium P2 is heated between the pressure roller 40 and the heating belt 60, the contact mechanism 70 pressurizes both end portions of the pressure roller 40 in the axial direction toward the heating belt 60 side so as to bend the pressure roller 40 along the convex shape of the heating belt 60.

Then, in the present exemplary embodiment, when the acquisition unit 50A continuously acquires the plurality of jobs, the control unit 50B controls driving of the driving unit 79 of the contact mechanism 70 such that the pressure roller 40 is alternately positioned at the first contact position (see FIG. 18A) and the second contact position (see FIG. 18B) during the job interval between the preceding job and the succeeding job. At this time, the control unit 50B controls units of the fixing device 16 including the driving unit 42 to maintain heating of the heating belt 60 and rotation of the pressure roller 40 during the job interval.

Accordingly, in the non-existence state, the contact mechanism 70 switches the pressure roller 40 between the following first contact state (see FIG. 18A) and the following second contact state (see FIG. 18B) (hereinafter, the above operation is referred to as recovery operation). The first contact state is a state where the pressure roller 40 is in contact with the heating belt 60, which heats the pressure roller 40 while rotating together with the pressure roller 40, at the central portion in the axial direction and one end portion in the axial direction, and the range of contact with the heating belt 60 at the other end portion of the pressure roller 40 in the axial direction is made smaller than the range of contact at the central portion in the axial direction. Specifically, in the first contact state, the pressure roller 40 is not in contact with the heating belt 60 at the other end portion of the pressure roller 40 in the axial direction.

The second contact state is a state where the pressure roller 40 is in contact with the heating belt 60, which heats the pressure roller 40 while rotating together with the pressure roller 40, at the central portion in the axial direction and the other end portion in the axial direction, and the range of contact with the heating belt 60 at one end portion of the pressure roller 40 in the axial direction is made smaller than the range of contact at the central portion in the axial direction. Specifically, in the second contact state, the pressure roller 40 is not in contact with the heating belt 60 at one end portion of the pressure roller 40 in the axial direction. Accordingly, the heating belt 60 is switched between the first contact state (see FIG. 18A) and the second contact state (see FIG. 18B), so that a heating amount at both end portions of the pressure roller 40 in the axial direction is smaller than a heating amount at the central portion of the pressure roller 40 in the axial direction.

Here, when a plurality of jobs are consecutive, there may be a case in which a recording medium P2 having a width direction dimension smaller than a belt width direction dimension of the contact region 50S (hereinafter, referred to as small-sized recording medium P2) is used in the preceding job, and a recording medium P2 having a width direction dimension larger than the width direction dimension of the recording medium P2 used in the preceding job (hereinafter, referred to as large-sized recording medium P2) is used in the succeeding job (see FIG. 17). The width direction dimension of the recording medium P2 used in the succeeding job is, for example, equal to the belt width direction dimension of the contact region 50S (specifically, a dimension slightly smaller than the belt width direction dimension of the contact region 50S).

Figure 23:
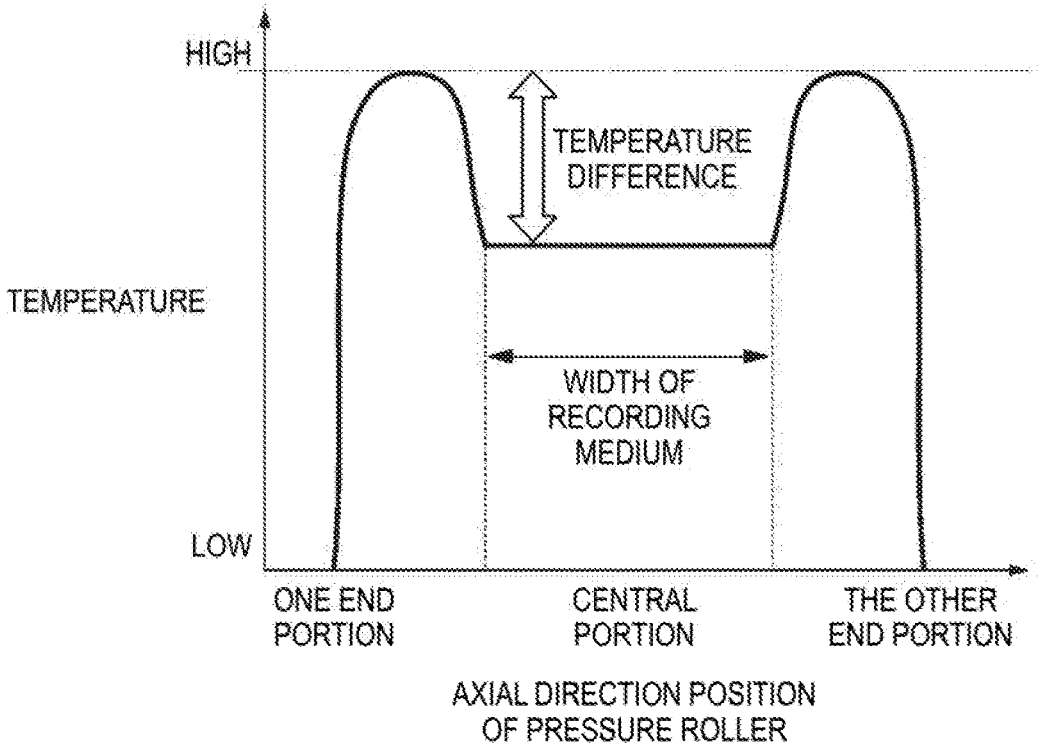
FIG. 23 is a graph showing a relationship between an axial direction position and a temperature of the pressure roller according to the fourth exemplary embodiment.

In the preceding job, when the small-sized recording medium P2 passes through the contact region 50S, heat of the heating belt 60 is transmitted to the pressure roller 40 via the recording medium P2 at the central portion in the belt width direction. On the other hand, at both end portions of the heating belt 60 in the belt width direction, the heat of the heating belt 60 is transmitted to the pressure roller 40 without passing through the recording medium P2. Therefore, as indicated by broken lines in FIG. 23, a temperature is lower at the central portion of the pressure roller 40 in the axial direction than at both end portions in the axial direction.

Then, in the non-existence state (that is, during the job interval), in a configuration in which the pressure roller 40 and the heating belt 60 continue being in contact with each other from one end portion in the axial direction to the other end portion in the axial direction (hereinafter, referred to as first configuration), the state where the temperature is lower at the central portion of the pressure roller 40 in the axial direction than at both end portions in the axial direction (state indicated by the broken lines in FIG. 23) is maintained even in the succeeding job.

Accordingly, when temperature unevenness occurs in the axial direction of the pressure roller 40, due to thermal expansion at both end portions of the pressure roller 40 in the axial direction, an outer diameter difference between both end portions in the axial direction and the central portion in the axial direction of the pressure roller 40 is increased. As a result, in the succeeding job, when the large-sized recording medium P2 passes through the contact region 50S, a feed speed of the recording medium P2 may become too high at both end portions in the width direction as compared with at the central portion, and a wrinkle may occur on the recording medium P2 in the succeeding job.

Further, when the temperature unevenness in the axial direction of the pressure roller 40 occurs, fixing unevenness of an image may occur in a width direction of the recording medium P2 in the succeeding job.

Figure 24:
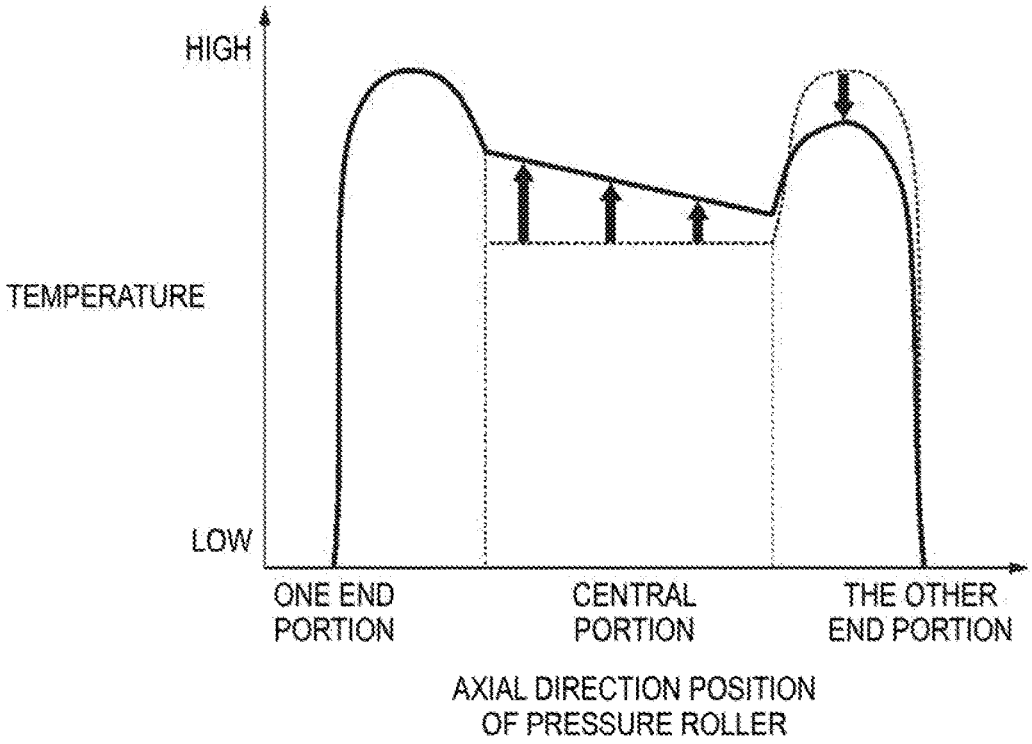
FIG. 24 is a graph showing a relationship between an axial direction position and a temperature of a pressure roller in a state where the pressure roller according to the fourth exemplary embodiment is positioned at the first contact position.

On the contrary, in the recovery operation of the present exemplary embodiment, the pressure roller 40 is switched between the first contact state and the second contact state. In the first contact state, the central portion of the pressure roller 40 in the axial direction and one end portion of the pressure roller 40 in the axial direction are heated by the heating belt 60, and the other end portion of the pressure roller 40 in the axial direction is not heated. Therefore, as shown in FIG. 24, a temperature is increased at the central portion of the pressure roller 40 in the axial direction, and a temperature is decreased at the other end portion of the pressure roller 40 in the axial direction.

Figure 25:
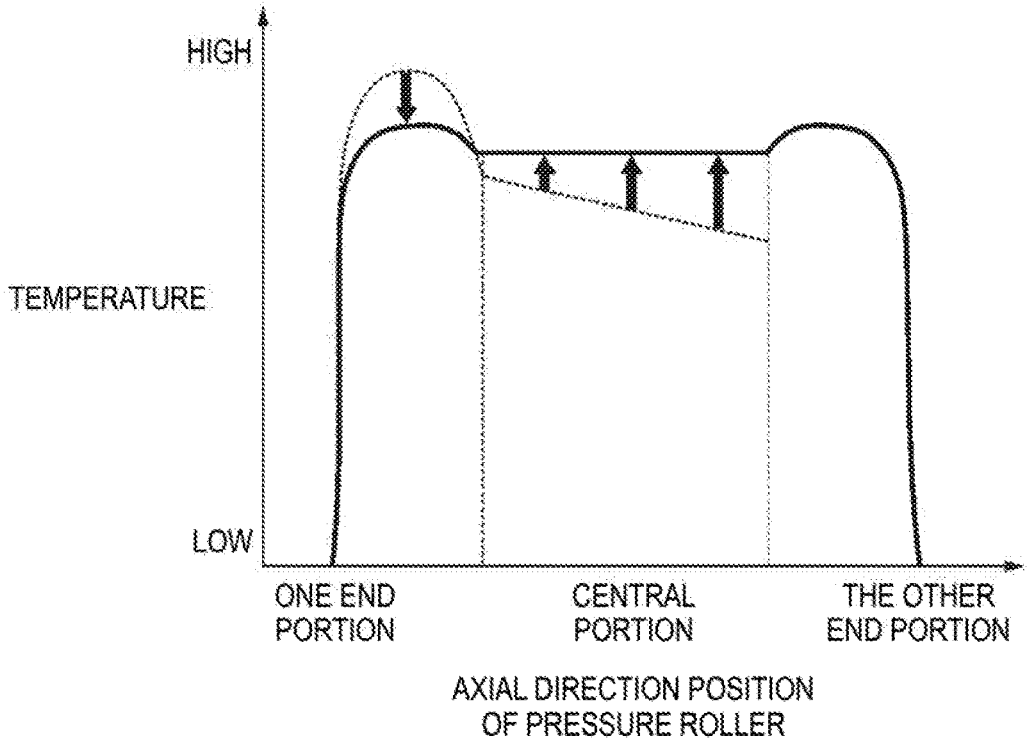
FIG. 25 is a graph showing a relationship between an axial direction position and a temperature of a pressure roller in a state where the pressure roller according to the fourth exemplary embodiment is positioned at the second contact position.

In the second contact state, the central portion of the pressure roller 40 in the axial direction and the other end portion of the pressure roller 40 in the axial direction are heated by the heating belt 60, and one end portion of the pressure roller 40 in the axial direction is not heated. Therefore, as shown in FIG. 25, a temperature is increased at the central portion of the pressure roller 40 in the axial direction, and a temperature is decreased at one end portion of the pressure roller 40 in the axial direction.

Accordingly, after the recording medium P2 passes through between the central portion of the pressure roller 40 in the axial direction and the central portion of the heating belt 60 in the axial direction, temperature unevenness in the axial direction of the pressure roller is reduced in a short time as compared with the first configuration.

Accordingly, according to the configuration of the present exemplary embodiment, since the temperature unevenness in the axial direction of the pressure roller is reduced in a short time, as compared with the first configuration, a wrinkle of the recording medium P2 due to an outer diameter difference between both end portions of the pressure roller 40 in the axial direction and the central portion of the pressure roller 40 in the axial direction is prevented in the succeeding job. Further, according to the configuration of the present exemplary embodiment, as compared with the first configuration, fixing unevenness of an image that occurs in a width direction of the recording medium P2 is prevented in the succeeding job. Accordingly, according to the configuration of the present exemplary embodiment, as compared with the first configuration, a defect of the image formed on the recording medium P2 is prevented in the succeeding job.

Particularly, in the recovery operation of the present exemplary embodiment, the other end portion of the pressure roller 40 in the axial direction and one end portion of the pressure roller 40 in the axial direction are not alternately in contact with the heating belt 60 during the job interval. Therefore, during the job interval, as compared with a configuration in which the other end portion of the pressure roller 40 in an axial direction and one end portion of the pressure roller 40 in the axial direction are simultaneously in contact with the heating belt 60 (hereinafter, referred to as second configuration), after the recording medium P2 passes through between the central portion of the pressure roller 40 in the axial direction and the central portion of the heating belt 60 in the axial direction, the temperature unevenness in the axial direction of the pressure roller is reduced in a short time.

More specifically, in the recovery operation of the present exemplary embodiment, the spaces 46 are alternately formed between the other end portion of the pressure roller 40 in the axial direction and the other end portion of the heating belt 60 in the axial direction, and between one end portion of the pressure roller 40 in the axial direction and one end portion of the heating belt 60 in the axial direction during the job interval. Therefore, as compared with the second configuration, air easily flows in the spaces 46 respectively between the other end portion of the pressure roller 40 in the axial direction and the other end portion of the heating belt 60 in the axial direction, and between one end portion of the pressure roller 40 in the axial direction and one end portion of the heating belt 60 in the axial direction. After the recording medium P2 passes through between the central portion of the pressure roller 40 in the axial direction and the central portion of the heating belt 60 in the axial direction, the temperature unevenness in the axial direction of the pressure roller is reduced in a short time.

In the present exemplary embodiment, in each of the state where the pressure roller 40 is positioned at the first contact position and the state where the pressure roller 40 is positioned at the second contact position (see FIG. 18B), the control unit 50B controls the driving unit 79 to rotate the pressure roller 40 a plurality of times. Accordingly, the contact mechanism 70 switches the pressure roller 40 between the first contact state and the second contact state while rotating the pressure roller 40 the plurality of times in each of the first contact state and the second contact state.

Therefore, as compared with a configuration in which the heating belt 60 is rotated less than two rotations in each of the first contact state and the second contact state, temperature unevenness in a rotation direction of the pressure roller 40 is reduced.

In the present exemplary embodiment, in each of the state where the pressure roller 40 is positioned at the first contact position and the state where the pressure roller 40 is positioned at the second contact position (see FIG. 18B), the control unit 50B controls the driving unit 79 to rotate the pressure roller 40 for the same rotation time.

Accordingly, the contact mechanism 70 switches the pressure roller 40 between the first contact state and the second contact state while rotating the pressure roller 40 for the same rotation time in each of the first contact state and the second contact state.

Therefore, as compared with a configuration in which the heating belt 60 is rotated for different rotation times in each of the first contact state and the second contact state, the temperature unevenness in the rotation direction of the pressure roller 40 is reduced.

In the present exemplary embodiment, the first cam 71A and the second cam 72A have different shapes. Therefore, as compared with a configuration in which phases of a pair of cams having the same shape are changed, a degree of freedom in adjusting a positional relationship between the pressure roller 40 and the heating belt 60 in the first contact state and the second contact state is high.

In the present exemplary embodiment, in the heating state where the recording medium P2 is heated between the pressure roller 40 and the heating belt 60, the contact mechanism 70 pressurizes both end portions of the pressure roller 40 in the axial direction toward the heating belt 60 side, so that the pressure roller 40 is bent along the convex shape of the heating belt 60.

Therefore, as compared with a configuration in which a state where the pressure roller 40 is along an axial direction is maintained, fixing unevenness of an image on a recording medium in the heating state is prevented in the configuration in which the heating belt 60 is formed in the convex shape toward the pressure roller 40 side at the central portion in the axial direction.

Fifth Exemplary Embodiment

Next, a fifth exemplary embodiment will be described. The same components as those in the fourth exemplary embodiment are denoted by the same reference numerals, and description thereof is omitted as appropriate.

In the fourth exemplary embodiment, at the first contact position (see FIG. 18A), the pressure roller 40 is in contact with the heating belt 60 at one end portion in the axial direction and the central portion in the axial direction, and is not in contact with the heating belt 60 at the other end portion in the axial direction. Further, at the second contact position (see FIG. 18B), the pressure roller 40 is in contact with the heating belt 60 at the other end portion in the axial direction and the central portion in the axial direction, and is not in contact with the heating belt 60 at one end portion in the axial direction. In contrast thereto, the fifth exemplary embodiment is configured as follows.

Figure 26:
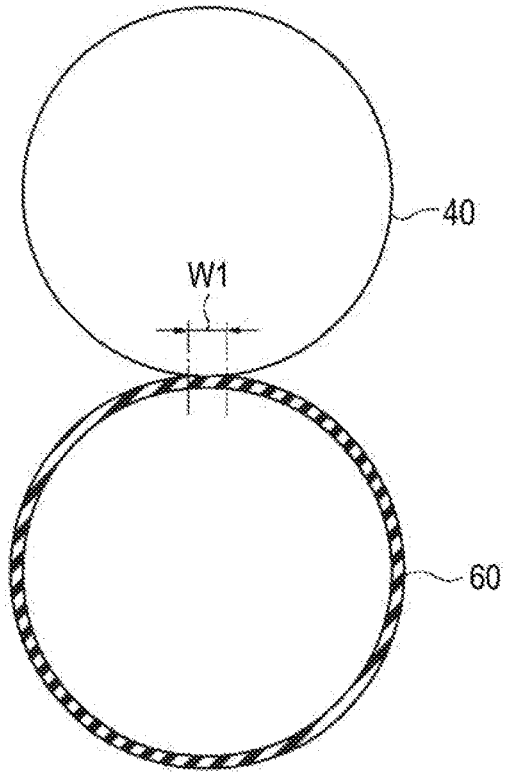
FIG. 26 is a schematic diagram showing a contact state with a heating belt at an end portion in an axial direction when a pressure roller according to a fifth exemplary embodiment is positioned at the first contact position and the second contact position.
Figure 27:
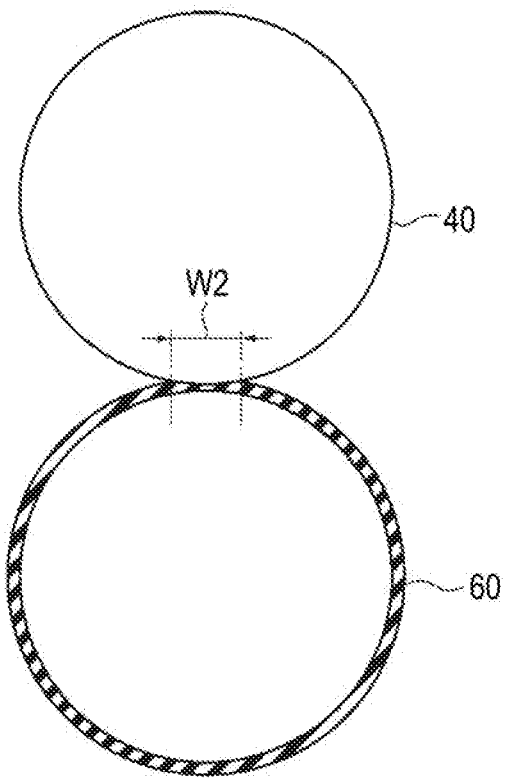
FIG. 27 is a schematic diagram showing a contact state with the heating belt at a central portion in the axial direction when the pressure roller according to the fifth exemplary embodiment is positioned at the first contact position and the second contact position.

That is, in the fifth exemplary embodiment, at a first contact position, the pressure roller 40 is in contact with the heating belt 60 at one end portion in an axial direction and a central portion in the axial direction, and is in contact with the heating belt 60 at the other end portion in the axial direction such that a range of contact with the heating belt 60 is smaller than a range of contact at the central portion in the axial direction. Specifically, in the pressure roller 40, at the first contact position, a contact width W1 (see FIG. 26) of the other end portion in the axial direction in a rotation direction to the heating belt 60 (that is, circumferential direction) is smaller than a contact width W2 (see FIG. 27) of the central portion in the axial direction.

At the second contact position, the pressure roller 40 is in contact with the heating belt 60 at the other end portion in the axial direction and the central portion in the axial direction, and is in contact with the heating belt 60 at one end portion in the axial direction such that the range of contact with the heating belt 60 is smaller than the range of contact at the central portion in the axial direction. Specifically, in the pressure roller 40, at the second contact position, the contact width W1 (see FIG. 26) of one end portion in the axial direction in the rotation direction to the heating belt 60 (that is, circumferential direction) is smaller than the contact width W2 (see FIG. 27) of the central portion in the axial direction.

Hereinafter, functions of the fifth exemplary embodiment will be described.

In the present exemplary embodiment, when the acquisition unit 50A continuously acquires a plurality of jobs, the control unit 50B controls driving of the driving unit 79 of the contact mechanism 70 such that the pressure roller 40 is alternately positioned between the first contact position and the second contact position during a job interval. At this time, the control unit 50B controls units of the fixing device 16 including the driving unit 42 to maintain heating of the heating belt 60 and rotation of the pressure roller 40 during the job interval.

Accordingly, in the non-existence state, the contact mechanism 70 switches the pressure roller 40 between the following first contact state and the following second contact state (hereinafter, the above operation is referred to as recovery operation). The first contact state is a state where the pressure roller 40 is in contact with the heating belt 60, which heats the pressure roller 40 while rotating together with the pressure roller 40, at the central portion in the axial direction and one end portion in the axial direction, and the range of contact with the heating belt 60 at the other end portion of the pressure roller 40 in the axial direction is made smaller than the range of contact at the central portion in the axial direction. Specifically, in the first contact state, the pressure roller 40 is not in contact with the heating belt 60 at the other end portion of the pressure roller 40 in the axial direction.

The second contact state is a state where the pressure roller 40 is in contact with the heating belt 60, which heats the pressure roller 40 while rotating together with the pressure roller 40, at the central portion in the axial direction and the other end portion in the axial direction, and the range of contact with the heating belt 60 at one end portion of the pressure roller 40 in the axial direction is made smaller than the range of contact at the central portion in the axial direction. Specifically, in the second contact state, the pressure roller 40 is not in contact with the heating belt 60 at one end portion of the pressure roller 40 in the axial direction. Accordingly, the heating belt 60 is switched between the first contact state (see FIG. 18A) and the second contact state (see FIG. 18B), so that a heating amount at both end portions of the pressure roller 40 in the axial direction is smaller than a heating amount at the central portion of the pressure roller 40 in the axial direction.

Therefore, after the recording medium P2 passes through between the central portion of the pressure roller 40 in the axial direction and the central portion of the heating belt 60 in the axial direction, as compared with the above-described first configuration, temperature unevenness in the axial direction of the pressure roller is reduced in a short time.

Accordingly, according to the configuration of the present exemplary embodiment, since the temperature unevenness in the axial direction of the pressure roller is reduced in a short time, as compared with the first configuration, a wrinkle of the recording medium P2 due to an outer diameter difference between both end portions of the pressure roller 40 in the axial direction and the central portion of the pressure roller 40 in the axial direction is prevented in the succeeding job. Further, according to the configuration of the present exemplary embodiment, as compared with the first configuration, fixing unevenness of an image that occurs in a width direction of the recording medium P2 is prevented in the succeeding job. Accordingly, according to the configuration of the present exemplary embodiment, as compared with the first configuration, a defect of the image formed on the recording medium P2 is prevented in the succeeding job.

In the recovery operation of the present exemplary embodiment, during the job interval, since the pressure roller 40 is in contact with the heating belt 60 at the central portion and both end portions in the axial direction, one of the pressure roller 40 and the heating belt 60 is supported by the other. Therefore, during the job interval, as compared with a configuration in which the pressure roller 40 is not in contact with the heating belt 60 at both end portions in an axial direction, an angle of one of the pressure roller 40 and the heating belt 60 with respect to the other does not easily change.

In the recovery operation of the present exemplary embodiment, since the pressure roller 40 is in contact with the heating belt 60 at the central portion and both end portions in the axial direction during the job interval, as compared with a configuration in which the pressure roller 40 is not in contact with the heating belt 60 at both end portions in an axial direction during a job interval, the heating belt 60 is stably rotated following the pressure roller 40.

Sixth Exemplary Embodiment

Next, a sixth exemplary embodiment will be described. The same components as those in the fourth exemplary embodiment are denoted by the same reference numerals, and description thereof is omitted as appropriate.

In the fourth exemplary embodiment, as described above, when the acquisition unit 50A continuously acquires the plurality of jobs, the control unit 50B controls the driving unit 79 to position the pressure roller 40 at the second contact position during the job interval. In contrast thereto, the sixth exemplary embodiment is configured as follows.

That is, in the sixth exemplary embodiment, when the acquisition unit 50A continuously acquires a plurality of jobs, as shown in FIG. 17, during a job interval in a case where a width direction dimension of a recording medium P2 used in a succeeding job is larger than a width direction dimension of a recording medium P2 used in a preceding job (hereinafter, referred to as "case where a dimension of a succeeding medium is large"), the control unit 50B controls the driving unit 79 to alternately position the pressure roller 40 at a first contact position (see FIG. 18A) and a second contact position (see FIG. 18B).

In other words, in a non-existence state between recording media P2 in a case where after a recording medium P2 passes through the contact region 50S, a recording medium P2 having a width direction dimension larger than that of the recording medium P2 is transported, a recovery operation is executed.

In the present exemplary embodiment, when a width direction dimension of a recording medium P2 used in the succeeding job is smaller than a width direction dimension of a recording medium P2 used in the preceding job, no recovery operation is executed during a job interval thereof. Specifically, for example, the control unit 50B controls the driving unit 79 to position the pressure roller 40 at a separated position.

The control unit 50B specifies, for example, a width direction dimension of the recording medium P2 in job information. Further, the control unit 50B may specify the width direction dimension of the recording medium P2 based on a detection result of a detection unit such as a sensor.

Here, in the case where the dimension of the succeeding medium is large, the pressure roller 40 is in contact with the recording medium P2 at portions on both end sides in the axial direction in the succeeding job as compared with a case of the preceding job. Accordingly, when an outer diameter difference between both end portions of the pressure roller 40 in the axial direction and the central portion of the pressure roller 40 in the axial direction becomes large due to thermal expansion at both end portions of the pressure roller 40 in the axial direction, a feed speed of the recording medium P2 is likely to be faster at both end portions in a width direction than at the central portion.

Therefore, in the case where the dimension of the succeeding medium is large, in a configuration in which the pressure roller 40 and the heating belt 60 continue being in contact with each other from one end portion in an axial direction to the other end portion in the axial direction (hereinafter, referred to as third configuration), a wrinkle is likely to occur on the recording medium P2 in the succeeding job.

On the contrary, in the present exemplary embodiment, during a job interval in the case where the dimension of the succeeding medium is large, since the recovery operation is executed, an effect of preventing a wrinkle of a transported recording medium P2 is high as compared with the third configuration.

In the above-described sixth exemplary embodiment, although the recovery operation is executed in the case where the dimension of the succeeding medium is large, the present invention is not limited thereto. For example, as a result of executing the preceding job, when a temperature difference between the central portion of the pressure roller 40 in the axial direction and at least one of both end portions is equal to or larger than a predetermined threshold, a configuration in which the recovery operation is executed may be adopted. In this case, the recovery operation is executed based on, for example, information obtained by measuring temperatures of the central portion of the pressure roller 40 in the axial direction and both end portions of the pressure roller 40 in the axial direction by a detection unit such as a temperature sensor. Further, the temperature difference of the pressure roller 40 may be predicted based on the number of sheets of the recording media P2 on which a job is executed in the preceding job, and the recovery operation may be executed based on information thereof.

Other Exemplary Embodiments

In the above-described exemplary embodiments 1 to 3, when a plurality of jobs are executed, although the contact mechanism 70 positions the pressure roller 40 at the central contact position (see FIG. 5) so as to execute the recovery operation during the job interval, the present invention is not limited thereto. For example, when a single job is executed, a configuration may be adopted in which the contact mechanism 70 positions the pressure roller 40 at the separated position after the recovery operation is executed after execution of the job is completed. In this configuration, when a job is executed immediately after execution of the single job is completed, an influence of temperature unevenness in the axial direction of the pressure roller is suppressed.

In the above-described exemplary embodiments 4 to 6, when a plurality of jobs are executed, although the recovery operation is executed during the job interval, the present invention is not limited thereto. For example, when a single job is executed, a configuration may be adopted in which the contact mechanism 70 positions the pressure roller 40 at the separated position after the recovery operation is executed after execution of the job is completed. In this configuration, when a job is executed immediately after execution of the single job is completed, an influence of temperature unevenness in the axial direction of the pressure roller is suppressed.

When a job is to be executed immediately after execution of a job is completed, a configuration may be adopted in which the job is executed after the recovery operation is executed before execution of the job.

Further, a configuration may be adopted in which the recovery operation is executed between recording media P2 in a single job.

In the above-described exemplary embodiments, although the pressure roller 40 is used as an example of a rotating body, the present invention is not limited thereto. For example, a pressure belt or the like may be used as an example of the rotating body.

In the above-described exemplary embodiments, although the heating belt 60 is used as an example of a heating body, the present invention is not limited thereto. For example, a heating roller or the like may be used as an example of the heating body.

The present invention is not limited to the above-described exemplary embodiments, and various modifications, changes and improvements can be made without departing from the scope of the present invention. For example, the modifications shown above may be combined with each other as appropriate.

What is claimed is:

1. A heating device comprising:

a rotating body;

a heating body configured to rotate together with the rotating body, and heat a material to be heated while sandwiching and transporting the material to be heated between the heating body and the rotating body; and a contact mechanism configured to cause the rotating body to be in contact with the heating body at a central portion of the rotating body in a rotation axis direction of the rotating body, the heating body being configured to heat the rotating body while rotating together with the rotating body, so that an area of the rotating body in contact with the heating body at each of both end portions of the rotating body in the rotation axis direction is smaller than an area of the rotating body in contact with the heating body at the central portion of the rotating body in the rotation axis direction, in a non-existence state where the material to be heated does not exist between the rotating body and the heating body after the material to be heated passes between the rotating body and the heating body, wherein the contact mechanism comprises a member configured to push the end portions and configured to increase or decrease a pushing amount, wherein the member is configured to decrease the area of the rotating body in contact with the heating body at each of both end portions of the rotating body in the rotation axis direction by decreasing the pushing amount in the non-existence state.

2. The heating device according to claim 1, wherein, in the non-existence state, the contact mechanism is configured to cause both end portions of the rotating body in the rotation axial direction not to be in contact with the heating body and cause the central portion of the rotating body in the rotation axial direction in contact with the heating body, or the contact mechanism is configured to make a contact width of the rotating body with the heating body in a rotation direction of the rotating body smaller at each of the both end portions of the rotating body in the rotation axis direction than at the central portion of the rotating body in the rotation axis direction.

3. The heating device according to claim 1, wherein, in the non-existence state, the contact mechanism is configured to cause the rotating body not to be in contact with the heating body at the both end portions of the rotating body in the rotation axis direction.

4. The heating device according to claim 1, wherein the heating body has a convex shape toward the rotating body at the central portion of the rotating body in the rotation axis direction, and wherein the contact mechanism is configured to move the rotating body farther away from the heating body in the non-existence state than in a heating state where the material to be heated is heated between the rotating body and the heating body.

5. The heating device according to claim 4, wherein the rotating body is a roller having a larger diameter at the both end portions of the rotating body than at the central portion of the rotating body in the rotation axis direction, and wherein a recessed dimension, by which the rotating body is recessed at the central portion of the rotating body than at the both end portions of the rotating body in the rotation axis direction of the rotating body, is smaller than a protruding dimension, by which the heating body is protruded at a central portion of the heating body than both end portions of the heating body in a rotation axis direction of the heating body.

6. The heating device according to claim 1, wherein the contact mechanism is configured to cause the rotating body to be in contact with the heating body at the central portion of the rotating body in the rotation axis direction, the heating body being configured to heat the rotating body while rotating together with the rotating body, so that the area of the rotating body in contact with the heating body at each of the both end portions of the rotating body in the rotation axis direction is smaller than the area of the rotating body in contact with the heating body at the central portion of the rotating body in the rotation axis direction, in a non-existence state where the material to be heated does not exist between the rotating body and the heating body, and at a timing after a material to be heated passes between the rotating body and the heating body, and before an another material to be heated, which has a larger dimension in the rotation axis direction than the material to be heated, is to be transported.

7. A fixing device serving as a heating device according to claim 1, wherein the rotating body is a pressure roller, and wherein while a recording medium as the material to be heated is sandwiched and transported between the pressure roller and the heating body, the recording medium is pressurized and heated so as to fix an image onto the recording medium.

8. The fixing device according to claim 7, wherein the heating body has a convex shape toward the rotating body at the central portion of the rotating body in the rotation axis direction, and wherein, in a heating state where the recording medium is heated between the pressure roller and the heating body, the contact mechanism is configured to pressurize both end portions of the pressure roller in a rotation axis direction of the pressure roller toward the heating body so as to bend the pressure roller along the convex shape of the heating body, and wherein, in the non-existence state, the contact mechanism is configured to move the rotating body away from the heating body.

9. An image forming apparatus comprising:

the fixing device according to claim 7; and a forming unit configured to form an image on the recording medium.

10. The image forming apparatus according to claim 9, wherein, during a job interval that is the non-existence state, the contact mechanism of the fixing device is configured to cause the pressure roller to be in contact with the heating body at a central portion of the pressure roller in a rotation axis direction of the pressure roller, the heating body being configured to heat the pressure roller while rotating together with the pressure roller, so that an area of the pressure roller in contact with the heating body at each of both end portions of the pressure roller in the rotation axis direction of the pressure roller is smaller than an area of the pressure roller in contact with the heating body at the central portion of the pressure roller in the rotation axis direction of the pressure roller.

11. A heating device comprising:

a rotating body;

a heating body configured to rotate together with the rotating body, and heat a material to be heated while sandwiching and transporting the material to be heated between the heating body and the rotating body; and a contact mechanism configured to switch the rotating body between a first contact state and a second contact state in a non-existence state where the material to be heated does not exist between the rotating body and the heating body after the material to be heated passes between the rotating body and the heating body, wherein the first contact state is a state where the rotating body is in contact with the heating body at a central portion of the rotating body and one end portion of the rotating body in a rotation axis direction of the rotating body, the heating body being configured to heat the rotating body while rotating together with the rotating body, so that an area of the rotating body in contact with the heating body at an other end portion of the rotating body in the rotation axis direction is smaller than an area of the rotating body in contact with the heating body at the central portion of the rotating body in the rotation axis direction, and wherein the second contact state is a state where the rotating body is in contact with the heating body at the central portion of the rotating body and the other end portion of the rotating body in the rotation axis direction, so that an area of the rotating body in contact with the heating body at the one end portion of the rotating body in the rotation axis direction is smaller than the area of the rotating body in contact with the heating body at the central portion of the rotating body in the rotation axis direction.

12. The heating device according to claim 11, wherein the contact mechanism is configured to, in the first contact state, cause the other end portion of the rotating body in the rotation axial direction not to be in contact with the heating body, or make a contact width of the rotating body with the heating body in a rotation direction of the rotating body smaller at the other end portion of the rotating body in the rotation axis direction than at the central portion of the rotating body in the rotation axis direction so as to make the area of the rotating body in contact with the heating body at the other end portion of the rotating body in the rotation axis direction smaller than the area of the rotating body in contact with the heating body at the central portion of the rotating body in the rotation axis direction and wherein the contact mechanism is configured to, in the second contact state, cause the one end portion of the rotating body in the rotation axial direction not to be in contact with the heating body, or make the contact width of the rotating body with the heating body in the rotation direction of the rotating body smaller at the one end portion of the rotating body in the rotation axis direction than at the central portion of the rotating body in the rotation axis direction so as to make the area of the rotating body in contact with the heating body at the one end portion of the rotating body in the rotation axis direction smaller than the area of the rotating body in contact with the heating body at the central portion of the rotating body in the rotation axis direction.

13. The heating device according to claim 11, wherein the contact mechanism is configured to cause, in the first contact state, the rotating body not to be in contact with the heating body at the other end portion of the rotating body in the rotation axis direction, and wherein the contact mechanism is configured to cause, in the second contact state, the rotating body not to be in contact with the heating body at the one end portion of the rotating body in the rotation axis direction.

14. The heating device according to claim 11, wherein the contact mechanism includes a first cam that is in contact with a first contacted portion disposed on the one end portion side of the rotating body in the rotation axis direction, and that includes a long diameter portion and a short diameter portion, and a second cam that is in contact with a second contacted portion disposed on the other end portion side of the rotating body in the rotation axis direction, and that includes a long diameter portion and a short diameter portion, wherein, the long diameter portion of the first cam is in contact with the first contacted portion at a first rotation position, and the short diameter portion of the first cam is in contact with the first contacted portion at a second rotation position, and wherein, the short diameter portion of the second cam is in contact with the second contacted portion at the first rotation position, and the long diameter portion of the second cam is in contact with the second contacted portion at the second rotation position.

15. The heating device according to claim 11, wherein the contact mechanism is configured to switch the rotating body between the first contact state and the second contact state while rotating the rotating body a plurality of times in each of the first contact state and the second contact state.

16. The heating device according to claim 11, wherein the contact mechanism is configured to switch the rotating body between the first contact state and the second contact state in a non-existence state where the material to be heated does not exist between the rotating body and the heating body, and at a timing after a material to be heated passes between the rotating body and the heating body, and before an another material to be heated, which has a larger dimension in the rotation axis direction than the material to be heated, is to be transported.

17. The heating device according to claim 11 which is a fixing device, wherein the rotating body is a pressure roller, and wherein while a recording medium as the material to be heated is sandwiched and transported between the pressure roller and the heating body, the recording medium is pressurized and heated so as to fix an image onto the recording medium.

18. An image forming apparatus comprising:

the fixing device according to claim 17; and a forming unit configured to form an image on the recording medium.

* * * * *